US011260499B2

(12) United States Patent
Takahashi et al.

(10) Patent No.: US 11,260,499 B2
(45) Date of Patent: Mar. 1, 2022

(54) POLISHING APPARATUS AND POLISHING METHOD

(71) Applicant: EBARA CORPORATION, Tokyo (JP)

(72) Inventors: Taro Takahashi, Tokyo (JP); Yuta Suzuki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 75 days.

(21) Appl. No.: 16/567,239

(22) Filed: Sep. 11, 2019

(65) Prior Publication Data

US 2020/0001428 A1 Jan. 2, 2020

Related U.S. Application Data

(62) Division of application No. 15/293,158, filed on Oct. 13, 2016, now Pat. No. 10,744,617.

(30) Foreign Application Priority Data

Oct. 16, 2015 (JP) ..... 2015-204767
Aug. 25, 2016 (JP) ..... 2016-164343

(51) Int. Cl.
*B24B 37/20* (2012.01)
*B24B 37/005* (2012.01)
(Continued)

(52) U.S. Cl.
CPC ..... *B24B 37/20* (2013.01); *B24B 37/005* (2013.01); *B24B 37/013* (2013.01);
(Continued)

(58) Field of Classification Search
CPC ..... B24B 37/20; B24B 37/005; B24B 37/013; B24B 37/042; B24B 37/046; B24B 49/10
See application file for complete search history.

(56) References Cited

U.S. PATENT DOCUMENTS 5,595,526 A * 1/1997 Yau ..... B24B 37/013 451/41
5,846,882 A 12/1998 Birang
(Continued)

FOREIGN PATENT DOCUMENTS

JP H09-262743 A 10/1997
JP H10-177976 A 6/1998
(Continued)

OTHER PUBLICATIONS

International Patent Application No. PCT/JP2015/074254; Int'l Written Opinion and the Search Report; dated Nov. 17, 2015; 6 pages.

*Primary Examiner* — Joel D Crandall
(74) *Attorney, Agent, or Firm* — BakerHostetler

(57) ABSTRACT

A polishing apparatus 100 includes a first electric motor 14 that rotationally drives a polishing table 12, and a second electric motor 22 that rotationally drives a top ring 20 that holds a semiconductor wafer 18. The polishing apparatus 100 includes: a current detection portion 24; an accumulation portion 110 that accumulates, for a prescribed interval, current values of three phases that are detected by the current detection portion 24; a difference portion 112 that determines a difference between a detected current value in an interval that is different to the prescribed interval and the accumulated current value; and an endpoint detection portion 29 that detects a polishing endpoint that indicates the end of polishing of the surface of the semiconductor wafer 18, based on a change in the difference that the difference portion 112 outputs.

19 Claims, 21 Drawing Sheets

(51) Int. Cl.
*B24B 37/04* (2012.01)
*B24B 37/013* (2012.01)
*B24B 49/10* (2006.01)

(52) U.S. Cl.
CPC ..... *B24B 37/042* (2013.01); *B24B 37/046* (2013.01); *B24B 49/10* (2013.01)

(56) References Cited

U.S. PATENT DOCUMENTS

| | | | | |
|---|---|---|---|---|
| 6,190,494 | B1 | 2/2001 | Dow | |
| 6,340,434 | B1 | 1/2002 | Mizuno et al. | |
| 6,547,637 | B1 | 4/2003 | Zhang | |
| 7,132,035 | B2 * | 11/2006 | Robinson | B24B 37/013 156/345.12 |
| 7,189,139 | B2 | 3/2007 | Ono | |
| 9,132,525 | B2 | 9/2015 | Shinozaki | |
| 9,272,389 | B2 | 3/2016 | Takahashi et al. | |
| 9,757,838 | B2 | 9/2017 | Shinozaki | |
| 2004/0189290 | A1 * | 9/2004 | Lehman | G01N 27/72 324/230 |
| 2007/0108066 | A1 | 5/2007 | Tsai et al. | |
| 2008/0081541 | A1 | 4/2008 | Kozasa et al. | |
| 2009/0111358 | A1 * | 4/2009 | Nakao | B24B 49/16 451/5 |
| 2010/0015889 | A1 | 1/2010 | Shimizu et al. | |
| 2014/0094098 | A1 | 4/2014 | Shinozaki | |
| 2015/0343594 | A1 | 12/2015 | Shinozaki | |
| 2017/0106493 | A1 | 4/2017 | Takahashi et al. | |
| 2017/0282325 | A1 | 10/2017 | Takahashi et al. | |

FOREIGN PATENT DOCUMENTS

| | | | |
|---|---|---|---|
| JP | H10-180625 | A | 7/1998 |
| JP | 2001-198813 | A | 7/2001 |
| JP | 2005-034992 | A | 2/2005 |
| JP | 2014-069255 | A | 4/2014 |
| JP | 2014-069256 | A | 4/2014 |
| JP | 5863614 | B2 | 2/2016 |
| TW | 200827659 | A | 7/2008 |
| TW | I331067 | B | 10/2010 |

* cited by examiner

| | SETTING VALUE | Max | Min |
|---|---|---|---|
| AMPLIFICATION | x10 | 200 | 100 |
| OFFSET | −100 | 100 | 0 |
| FILTER | | ATTENUATION AT FILTER | 0 |
| SECOND AMPLIFICATION | CORRECTION OF PORTION ATTENUATED AT FILTER | 100 | 0 |

78a 78b 78c 78d 78e 78f 78g 78h 78i 78j 78k 78ℓ

POLISHING APPARATUS AND POLISHING METHOD

CROSS-REFERENCE TO RELATED APPLICATION

This application is a divisional application of U.S. patent application U.S. Ser. No. 15/293,158, filed Oct. 13, 2016 and claims priority to Japanese Patent Applications No. 204767-2015 filed on Oct. 16, 2015 and 164343-2016 filed on Aug. 25, 2016. The entire disclosure of Japanese Patent Applications No. 204767-2015 filed on Oct. 16, 2015 and 164343-2016 filed on Aug. 25, 2016 are incorporated herein by reference in its entirety.

TECHNICAL FIELD

The present invention relates to a polishing apparatus and a polishing method.

BACKGROUND ART

In recent years, as the packing densities of semiconductor devices are becoming higher, wires of circuits are becoming finer and the distances between the wires are also becoming narrower. It is necessary to planarize the surface of a semiconductor wafer that is a polishing target, and polishing by a polishing apparatus is performed as one method of carrying out such planarization.

A polishing apparatus includes a polishing table for holding a polishing pad for polishing a polishing target, and a top ring for holding a polishing target and pressing the polishing target against the polishing pad. The polishing table and the top ring are each rotationally driven by a driving portion (for example, a motor). A liquid (slurry) that includes a polishing agent is caused to flow on the polishing pad, and the polishing target that is held by the top ring is pushed against the polishing pad to thereby polish the polishing target.

If the polishing of a polishing target by a polishing apparatus is insufficient, a problem arises such as the risk of a short-circuit occurring due to insulation between circuits not being achieved, while if excessive polishing is performed, problems arise such as an increase in resistance values due to a reduction in the cross-sectional area of the wiring, or the wiring itself is completely removed and the circuit itself is not formed. Therefore, it is necessary for a polishing apparatus to detect the optimal polishing endpoint.

As one polishing endpoint detection means, a method is known that detects a change in a polishing frictional force when polishing has transitioned to a substance that is made of a different material. A semiconductor wafer as a polishing target has a laminated structure made of different materials including a semiconductor material, a conductive material and an insulating material, and the coefficient of friction differs between the different material layers. Therefore, the aforementioned method detects a change in the polishing frictional force that is caused by the polishing transitioning to a different material layer. According to this method, a time at which the polishing reaches a different material layer is the endpoint of the polishing.

A polishing apparatus can also detect a polishing endpoint by detecting a change in a polishing frictional force when the polishing surface of the polishing target becomes flat from a state in which the polishing surface was not flat.

A polishing frictional force that arises when polishing a polishing target appears as the driving load of a driving portion. For example, in a case where a driving portion is an electrically-driven motor, a driving load (torque) can be measured as a current that flows to the motor. Therefore, the motor current (torque current) can be detected with a current sensor, and the endpoint of polishing can be detected based on a change in the detected motor current (Japanese Patent Laid-Open No. 2001-198813).

However, in a polishing process to be executed by a polishing apparatus, there are multiple polishing conditions that depend on a combination of factors such as the kind of polishing target, the kind of polishing pad and the kind of polishing abrasive liquid (slurry). Among multiple polishing conditions, in some cases a change (characteristic point) in a torque current is not significantly manifested even when a change arises in the driving load of a driving portion. In a case where a change in the torque current is small, there is a risk that it will not be possible to appropriately detect the endpoint of polishing due to the influence of noise that appears in the torque current or waviness that arises in the waveform of the torque current, and consequently a problem such as excessive polishing can arise.

Conventionally, measures have been taken such as removing noise from the torque current by means of a noise filter. However, in some cases noise that is caused by hardware (a motor) cannot be removed even when a noise filter is used, and there is a problem that the S/N does not improve. There is also the problem that a change in the torque current is small.

Note that, appropriately detecting the endpoint of polishing is also important with regard to dressing the polishing pad. Dressing is performed by a pad dresser which has a grinding stone such as a diamond disposed on the surface thereof being brought into contact with a polishing pad. The surface of the polishing pad is cut away or roughened by the pad dresser to improve a slurry retention property of the polishing pad prior to the start of polishing, or to restore the slurry retention property of the polishing pad during use to thus maintain the polishing capacity.

Therefore, an object of one form of the present invention is to favorably detect a change in a torque current and improve the accuracy of polishing endpoint detection even in a case where noise cannot be removed even though a noise filter is used.

Further, an object of another form of the present invention is to favorably detect a change in a torque current and improve the accuracy of polishing endpoint detection even in a case where a change in the torque current is small.

SUMMARY OF INVENTION

According to a first form of the polishing apparatus of the invention of the present application, a polishing apparatus is provided that has a first electric motor that rotationally drives a polishing table for performing polishing between a polishing pad and a polishing object that is disposed facing the polishing pad, and a second electric motor that rotationally drives a holding portion for holding the polishing object and pressing the polishing object against the polishing pad; the polishing apparatus further including: a current detection portion that detects a current value of at least one of the first and second electric motors; an accumulation portion that accumulates the detected current value for a prescribed interval; a difference portion that determines a difference between the detected current value in an interval that is different to the prescribed interval and the accumulated current value; and an endpoint detection portion that detects a polishing endpoint that indicates an end of the polishing, based on a change in the difference that the difference portion outputs.

In this case, the term "polishing object" refers to a semiconductor wafer when planarizing the surface of a semiconductor wafer that is a polishing target, and refers to a pad dresser when performing dressing of a polishing pad. Accordingly, the term "end of polishing" refers to, in the case of a semiconductor wafer, the end of polishing the surface of the semiconductor wafer, and in the case of performing dressing of a polishing pad, refers to the end of polishing the surface of the polishing pad.

According to a second form of the polishing apparatus of the invention of the present application, a polishing method is provided. The polishing method is a method for performing polishing between a polishing pad and a polishing object that is disposed facing the polishing pad and which uses a polishing apparatus having a first electric motor that rotationally drives a polishing table for holding the polishing pad, a second electric motor that rotationally drives a holding portion for holding the polishing object that is disposed facing the polishing pad and pressing the polishing object against the polishing pad, and a current detection portion that detects a current value of at least one of the first and second electric motors, the method including: an accumulation step of accumulating the detected current value for a prescribed interval; a difference step of determining a difference between the detected current value in an interval that is different to the prescribed interval and the accumulated current value; and an endpoint detection step of detecting a polishing endpoint that indicates an end of the polishing, based on a change in the difference that the difference step outputs. According to this form, the same advantageous effects as those of the first form can be achieved.

DESCRIPTION OF EMBODIMENTS

A polishing apparatus according to one embodiment of the present invention is described hereunder based on the accompanying drawings. First, the basic configuration of the polishing apparatus will be described, and thereafter detection of a polishing endpoint of a polishing target will be described.

Figure 1:
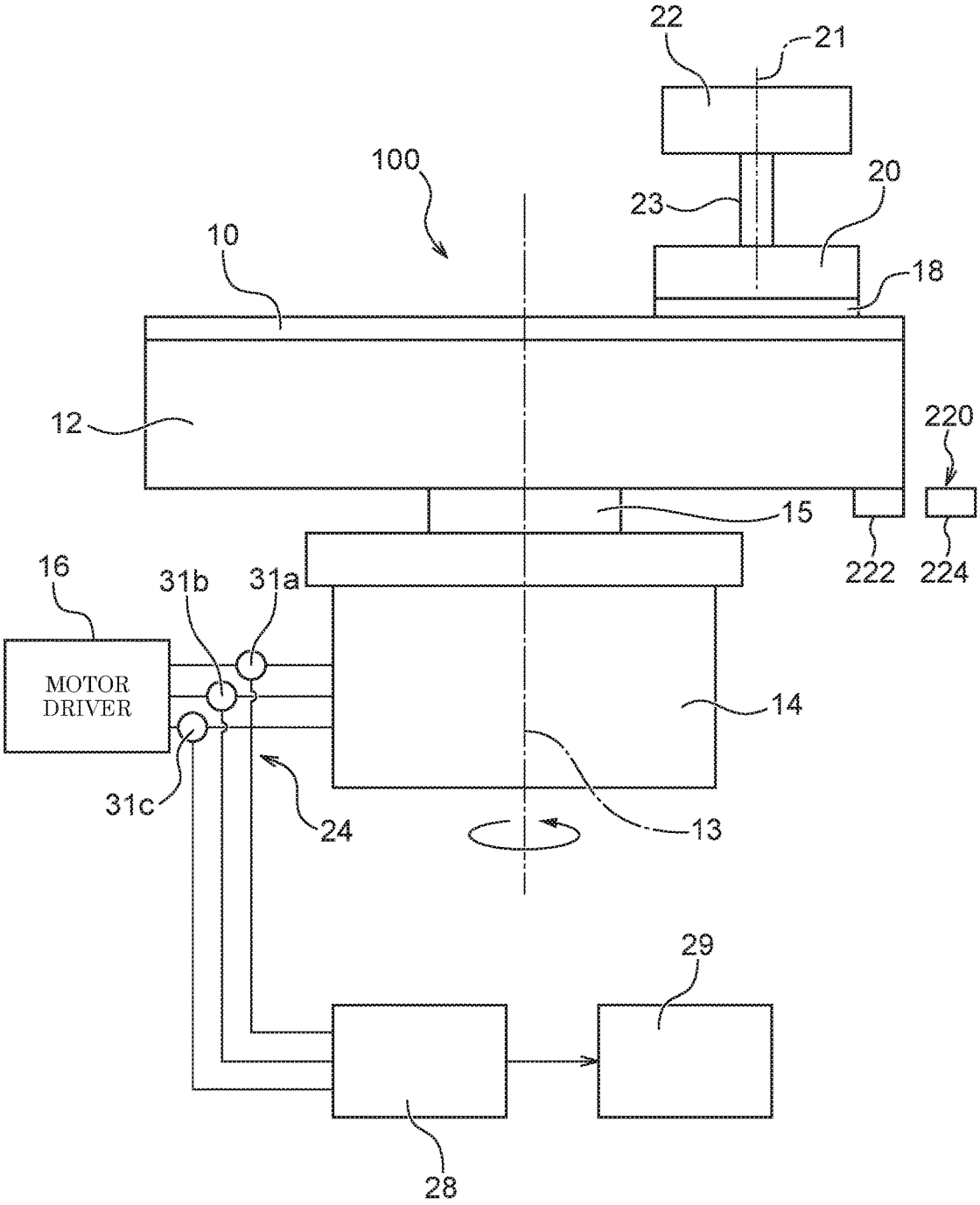
FIG. 1 is a view that illustrates the basic configuration of a polishing apparatus according to the present embodiment.

FIG. 1 is a view illustrating the basic configuration of a polishing apparatus 100 according to the present embodiment. The polishing apparatus 100 includes a polishing table 12 to which a polishing pad 10 can be attached to the top face thereof, a first electric motor 14 that rotationally drives the polishing table 12, a top ring (holding portion) 20 that is capable of holding a semiconductor wafer (polishing target) 18, and a second electric motor 22 that rotationally drives a top ring 20.

The top ring 20 is configured to be moved close to or away from the polishing table 12 by an unshown holding apparatus. When polishing the semiconductor wafer 18, by moving the top ring 20 close to the polishing table 12, the semiconductor wafer 18 that is held by the top ring 20 is caused to contact against the polishing pad 10 that is attached to the polishing table 12.

At the time of polishing the semiconductor wafer 18, the semiconductor wafer 18 that is held by the top ring 20 is pressed against the polishing pad 10 in a state in which the polishing table 12 is rotationally driven. Further, the top ring 20 is rotationally driven around an axis 21 that is eccentric relative to a rotational axis 13 of the polishing table 12 by the second electric motor 22. When polishing the semiconductor wafer 18, polishing abrasive liquid that includes a polishing agent is supplied from an unshown polishing agent supply apparatus onto the upper face of the polishing pad 10. The semiconductor wafer 18 that is set in the top ring 20 is pressed against the polishing pad 10 to which the polishing abrasive liquid has been supplied, in a state in which the top ring 20 is being rotationally driven by the second electric motor 22.

Preferably, the first electric motor 14 is a synchronous-type or induction-type AC servo motor provided with windings of at least the three phases of U-phase, V-phase, and W-phase. In the present embodiment, the first electric motor 14 includes an AC servo motor provided with the three phase windings. The three phase windings are configured such that currents having phases shifted by 120 degrees from each other are made to respectively flow through field windings provided around a rotor in the first electric motor 14, and thereby the rotor is rotationally driven. The rotor of the electric motor 14 is connected to a motor shaft 15, and the polishing table 12 is rotationally driven by the motor shaft 15. Note that, in the present invention, a motor other than a three-phase motor, such as a two-phase motor or a five-phase motor can also be applied. Further, a motor other than an AC servo motor, for example, a brushless DC motor can be applied.

Preferably, the second electric motor 22 is a synchronous-type or induction-type AC servo motor provided with windings of at least the three phases of U-phase, V-phase, and W-phase. In the present embodiment, the second electric motor 22 includes an AC servo motor provided with the three phase windings. The three phase windings are configured such that currents having phases shifted by 120 degrees from each other are made to respectively flow through field windings provided around a rotor in the second electric motor 22, and thereby the rotor is rotationally driven. The rotor of the second electric motor 22 is connected to a motor shaft 23, and the top ring 20 is rotationally driven by the motor shaft 23.

The polishing apparatus 100 also includes a motor driver 16 that rotationally drives the first electric motor 14. Note that, although only the motor driver 16 that rotationally drives the first electric motor 14 is illustrated in FIG. 1, the second electric motor 22 is also connected to a similar motor driver. The motor driver 16 outputs an alternating current for each of the U-phase, V-phase and W-phase, and rotationally drives the first electric motor 14 by means of this three-phase alternating current.

The polishing apparatus 100 has a current detection portion 24 that detects a three-phase alternating current that the motor driver 16 outputs, a rectification operation portion 28 that rectifies current detection values of three phases that are detected by the current detection portion 24, and adds the rectified signals of the three phases and outputs the resultant signal, and an endpoint detection portion 29 that detects a polishing endpoint that indicates the end of polishing of the surface of the semiconductor wafer 18 based on a change in the output of the rectification operation portion 28. Although the rectification operation portion 28 of the present embodiment performs only processing that adds signals of three phases, the rectification operation portion 28 may also perform multiplication after adding the signals. A configuration may also be adopted in which the rectification operation portion 28 performs only multiplication.

The current detection portion 24 includes current sensors 31*a*, 31*b* and 31*c* for the U-phase, V-phase and W-phase, respectively, to detect the three-phase alternating current that the motor driver 16 outputs. The current sensors 31*a*, 31*b* and 31*c* are provided on current paths for the U-phase, V-phase and W-phase between the motor driver 16 and the first electric motor 14, respectively. The current sensors 31*a*, 31*b* and 31*c* detect U-phase, V-phase and W-phase currents, respectively, and output the detected values to the rectification operation portion 28. Note that, a configuration may also be adopted in which the current sensors 31*a*, 31*b* and 31*c* are provided on current paths for the U-phase, V-phase and W-phase between an unshown motor driver and the second motor 22 for the top ring.

In the present embodiment, the current sensors 31*a*, 31*b* and 31*c* are Hall element sensors. The Hall element sensors are provided on the U-phase, V-phase and W-phase current paths, respectively. Magnetic fluxes that are proportional to the respective currents of the U-phase, V-phase and W-phase are converted to Hall voltages 32*a*, 32*b* and 32*c* by the Hall effect and the voltages are then output.

The current sensors 31*a*, 31*b* and 31*c* may be sensors that adopt a different method which can measure a current. For example, a current transformer method may be adopted that detects a current by means of secondary windings that are wound around ring-shaped cores (primary windings) that are provided on each of the U-phase, V-phase and W-phase current paths. In this case, output currents can be detected as voltage signals by causing the output currents to flow to load resistances.

Figure 2:
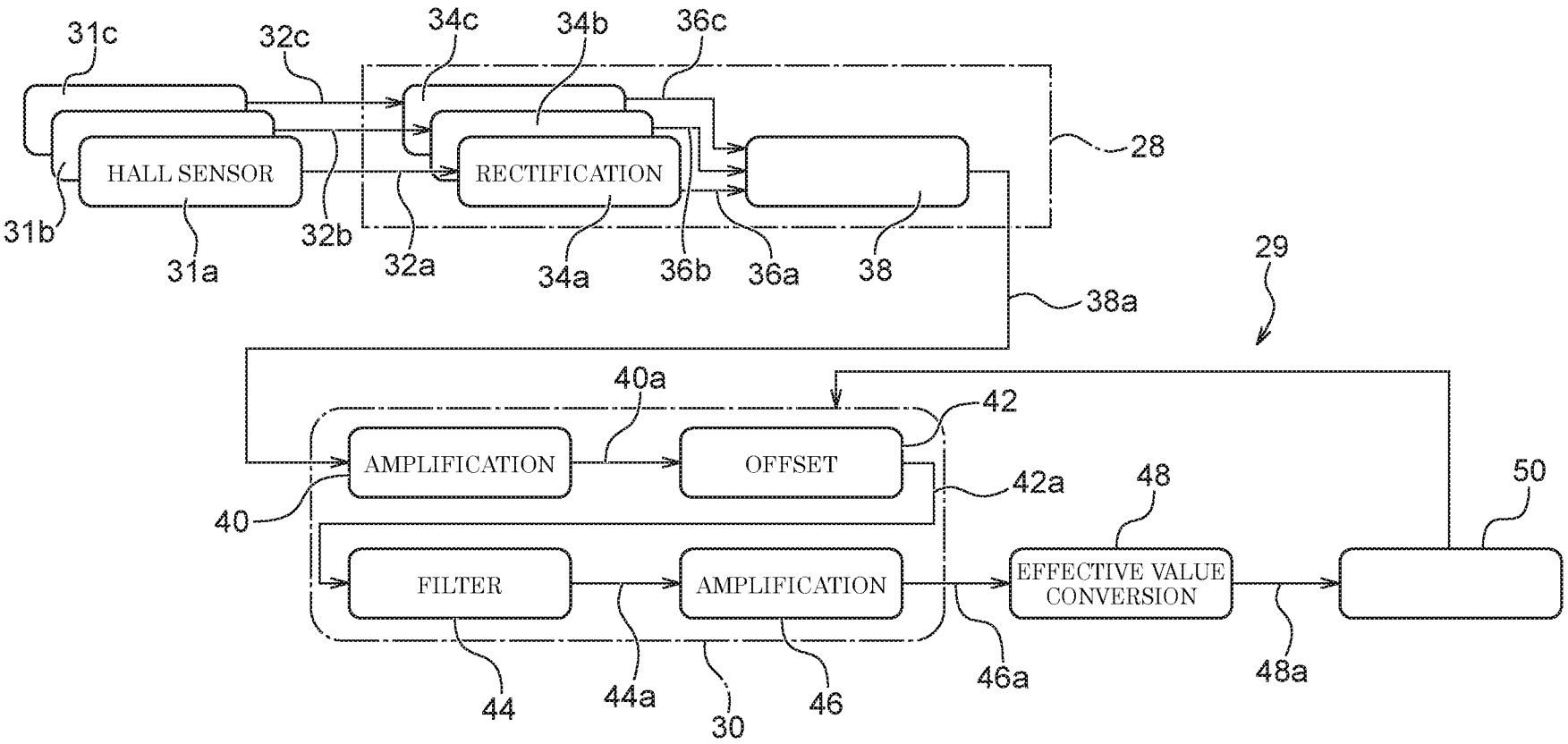
FIG. 2 is a block diagram illustrating details of an endpoint detection portion 29.
Figure 3:
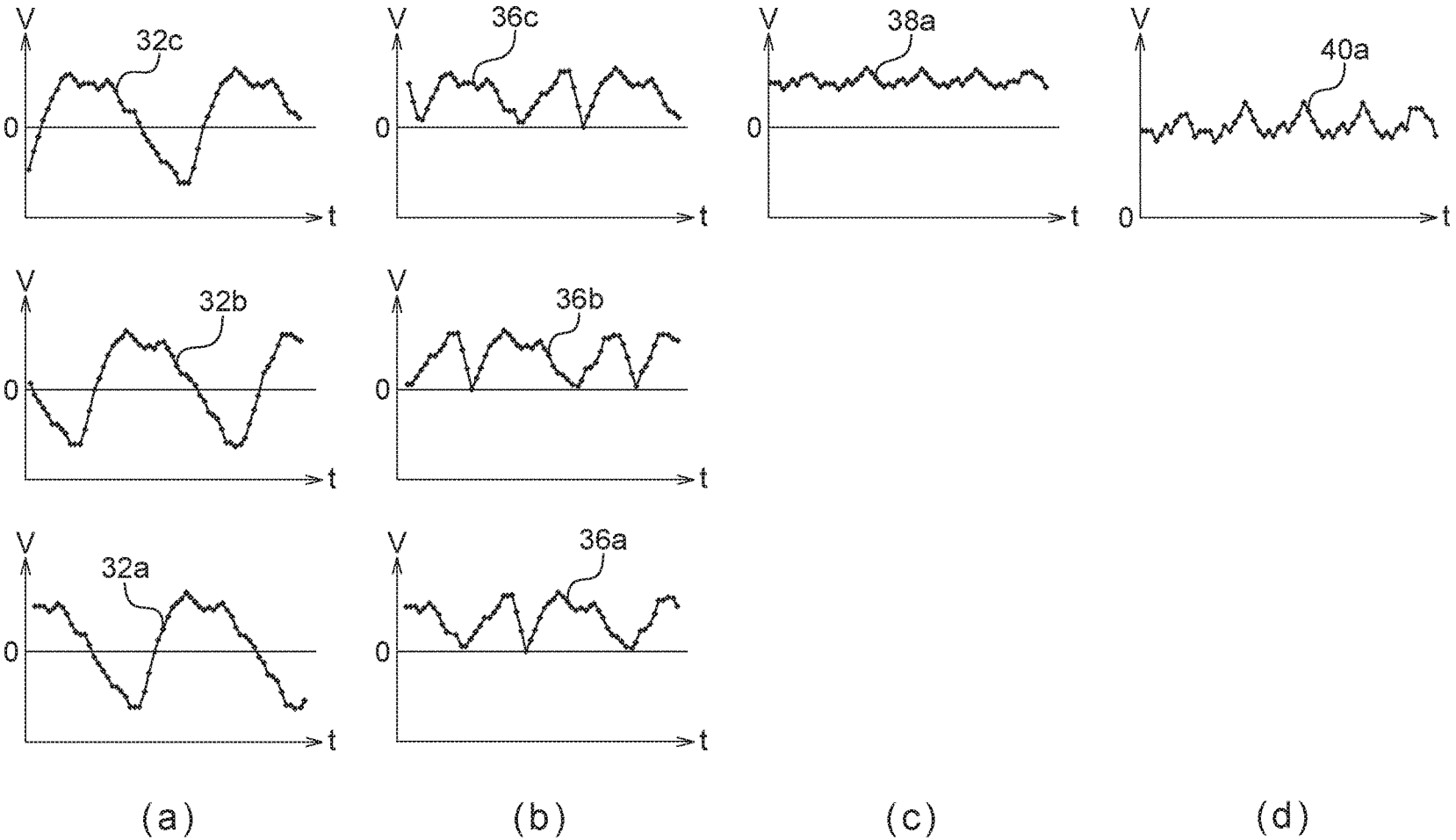
FIG. 3 is a multiple view drawing showing graphs that illustrate the contents of signal processing by the endpoint detection portion 29.
Figure 4:
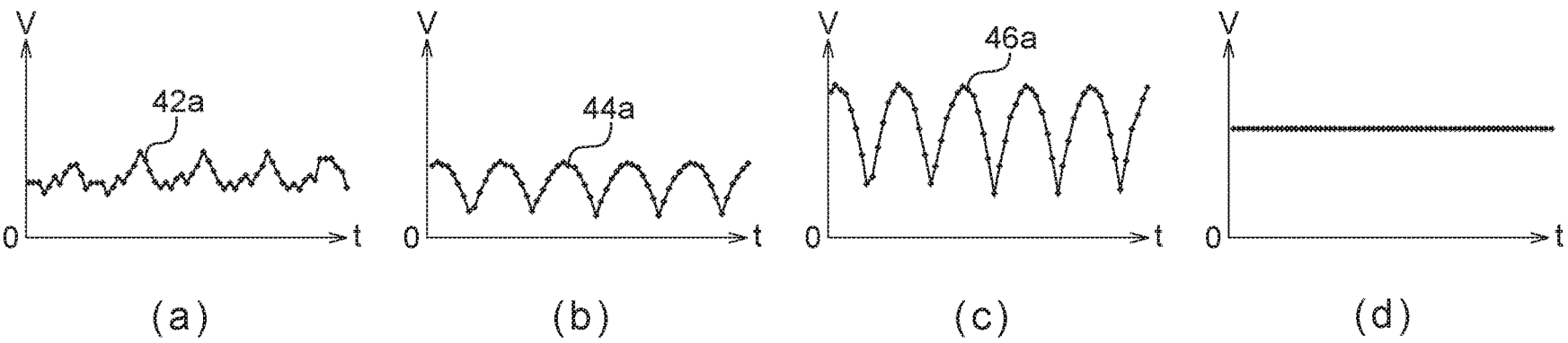
FIG. 4 is a multiple view drawing showing graphs that illustrate the contents of signal processing by the endpoint detection portion 29.

The rectification operation portion 28 rectifies the outputs of the plurality of current sensors 31*a*, 31*b* and 31*c*, and adds the rectified signals together. The endpoint detection portion 29 includes a processing portion 30 that processes the output of the rectification operation portion 28, an effective value converter 48 that subjects the output of the processing portion 30 to effective value conversion, and a control portion 50 that performs an operation to determine a polishing endpoint and the like. The details of the rectification operation portion 28 and the endpoint detection portion 29 will now be described with reference to FIGS. 2 to 4. FIG. 2 is a block diagram that illustrates the details of the rectification operation portion 28 and the endpoint detection portion 29. FIGS. 3 and 4 are graphs that illustrate the contents of signal processing by the rectification operation portion 28 and the endpoint detection portion 29.

The rectification operation portion 28 includes rectification portions 34*a*, 34*b* and 34*c* which rectify the output voltages 32*a*, 32*b* and 32*c* that are input from the plurality of current sensors 31*a*, 31*b* and 31*c*, and an operation portion 38 that adds together rectified signals 36*a*, 36*b* and 36*c*. Since the current value increases as a result of the addition, the detection accuracy improves. Note that, in the description of the embodiment, a signal wire and a signal that flows through the relevant signal wire are denoted by the same reference characters.

Although in the present embodiment, the output voltages 32*a*, 32*b* and 32*c* that are added are voltages for three phases, the present invention is not limited thereto. For example, output voltages for two phases may be added. Further, a configuration may be adopted in which output voltages for three phases or two phases of the second electric motor 22 are added, and endpoint detection is performed using the resultant value. In addition, a configuration may be adopted in which an output voltage for one phase or more of the first electric motor 14 and an output voltage for one phase or more of the second electric motor 22 are added.

FIG. 3(*a*) illustrates the output voltages 32*a*, 32*b* and 32*c* of the current sensors 31*a*, 31*b* and 31*c*. FIG. 3(*b*) illustrates the voltage signals 36*a*, 36*b* and 36*c* that are rectified and output by the rectification portions 34*a*, 34*b* and 34*c*, respectively. FIG. 3(*c*) illustrates a signal 38*a* that the operation portion 38 obtained by addition and then output. The horizontal axis in these graphs represents time and the vertical axis represents voltage.

The voltage signals 36*a*, 36*b* and 36*c* illustrated in FIG. 3 are voltage signals to which noise that is caused by hardware (a motor) is attached. A method for removing the noise that is caused by hardware (a motor) by means of a difference portion of the present invention is described later. In FIGS. 3 to 10, a case is illustrated in which a difference portion that removes noise caused by hardware (a motor) is provided at a stage prior to the rectification operation portion 28, the processing portion 30 or the effective value converter 48, and the relevant noise is removed. In FIGS. 3 to 10, a method is described which favorably detects a change in the torque current and improves the accuracy of polishing endpoint detection, even in a case where the change in the torque current is small.

The processing portion 30 includes an amplification portion 40 that amplifies an output 38*a* of the rectification operation portion 28, an offset portion (subtraction portion) 42 that subtracts a predetermined amount from the output of the rectification operation portion 28, a filter (noise removal portion) 44 that removes noise included in the output 38*a* of the rectification operation portion 28, and the second amplification portion 46 that further amplifies the signal from which noise was removed by the noise removal portion. In the processing portion 30, a signal 40*a* that was amplified by the amplification portion 40 is subjected to a subtraction operation at the offset portion 42, and the filter 44 then removes noise from a signal 42*a* obtained after the subtraction operation.

FIG. 3(*d*) illustrates the signal 40*a* that the amplification portion 40 amplifies and outputs. FIG. 4(*a*) illustrates the signal 42*a* that the offset portion 42 obtains by performing a subtraction operation on the signal 40*a* and outputs. FIG. 4(*b*) illustrates a signal 44*a* that the filter 44 obtains by removing noise included in the signal 42*a* and outputs. FIG. 4(*c*) illustrates a signal 46*a* that the second amplification portion 46 outputs that is obtained by further amplifying the signal 44*a* from which noise was removed. The horizontal axis in these graphs represents time, and the vertical axis represents voltage.

The amplification portion 40 is a portion that controls the amplitude of the output 38*a* of the rectification operation portion 28, and amplifies the amplitude of the output 38*a* by an amplification factor of a predetermined amount to increase the amplitude. The offset portion 42 extracts and processes a current part that depends on a change in a frictional force by removing a current part (bias) of a fixed amount that does not change even if the frictional force changes. By this means, the accuracy of the endpoint detection method that detects an endpoint based on a change in the frictional force improves.

The offset portion 42 subtracts only an amount to be deleted of the signal 40*a* that the amplification portion 40 outputs. A current that is detected usually includes a current part that changes accompanying a change in the frictional force, and a current part (bias) of a fixed amount that does not change even if the frictional force changes. This bias is the amount to be removed. By removing the bias, it is possible to extract only the current part that depends on a change in the frictional force and to amplify the resultant signal to the maximum amplitude in accordance with an input range of the effective value converter 48 at a subsequent stage, and thus the accuracy of the endpoint detection improves.

The filter 44 reduces unwanted noise that is included in the signal 42*a* that is input, and is normally a low-pass filter. The filter 44, for example, is a filter that allows only a frequency component that is lower than the rotational frequency of the motor to pass therethrough. This is because endpoint detection can be performed if there is only a direct-current component. The filter 44 may be a band-pass filter that allows a frequency component that is lower than the rotational frequency of the motor to pass therethrough. This is because endpoint detection can be performed in this case also.

The second amplification portion 46 is a component for adjusting the amplitude in accordance with the input range of the effective value converter 48 that is at a subsequent stage. The reason for adjusting the amplitude in accordance with the input range of the effective value converter 48 is that the input range of the effective value converter 48 is not infinite and also because it is desirable for the amplitude to be as large as possible. Note that, when the input range of the effective value converter 48 is increased, the resolution when subjecting the converted signal to analog/digital conversion by the A/D converter deteriorates. For these reasons, the input range with respect to input to the effective value converter 48 is kept at the optimal range by the second amplification portion 46.

An output 46*a* of the second amplification portion 46 is input to the effective value converter 48. The effective value converter 48 is a component that determines the mean during one alternating voltage cycle, that is, a direct-current voltage that is equal to the alternating voltage. An output 48*a* of the effective value converter 48 is shown in FIG. 4(*d*). The horizontal axis in this graph represents time, and the vertical axis represents voltage.

The output 48*a* of the effective value converter 48 is input to the control portion 50. The control portion 50 performs endpoint detection based on the output 48*a*. The control portion 50 determines that polishing of the semiconductor wafer 18 reached the endpoint in a case where a previously set condition is satisfied, such as a case where any one of the following conditions is satisfied. That is, the control portion 50 determines that polishing of the semiconductor wafer 18 reached the endpoint in a case where the output 48*a* became greater than a previously set threshold value, a case where the output 48*a* became less than a previously set threshold value, or a case where a time differential value of the output 48*a* satisfied a predetermined condition.

Figure 5:
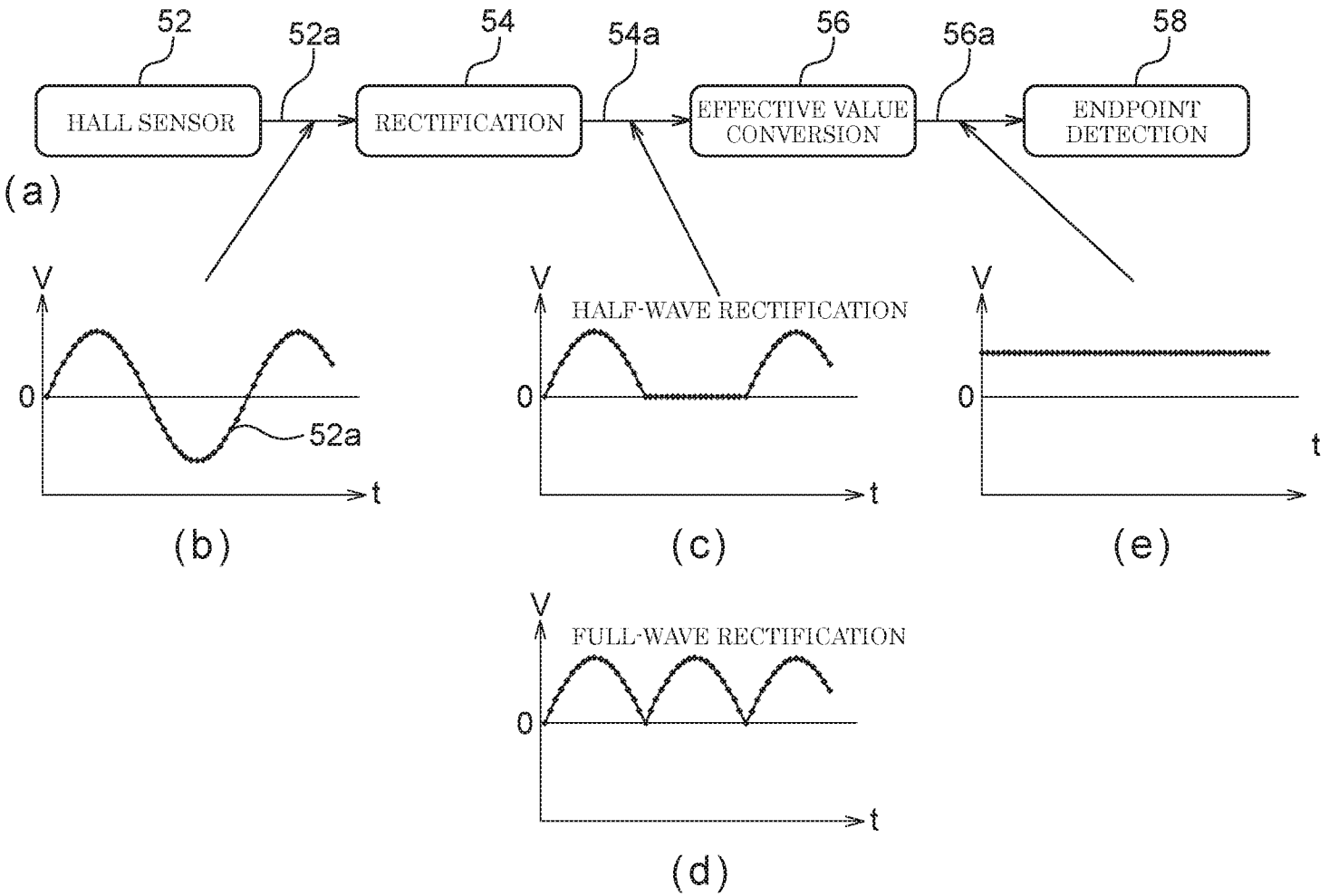
FIG. 5 is a multiple view drawing showing a block diagram and graphs that illustrate an endpoint detection method of a comparative example.

The effects of the present embodiment will now be described in contrast with a comparative example that uses current of a single phase only. FIG. 5 is a multiple view drawing showing a block diagram and graphs that illustrate an endpoint detection method of the comparative example. The purpose of the graphs shown in FIG. 5 is to illustrate the principles of the detection method, and the signals illustrated in the graphs are signals in a case where there is no noise. The horizontal axis in these graphs represents time, and the vertical axis represents voltage. In the comparative example, since only current of a single phase is used, there is no processing for addition. Processing for subtraction is also not performed. In FIG. 2 and FIG. 5, the Hall element sensor 31*a* and the Hall element sensor 52, the rectification portion 34*a* and the rectification portion 54, and the effective value converter 48 and the effective value converter 56 have equivalent performance to each other, respectively.

In the comparative example there is a single Hall element sensor 52 which is provided, for example, on the U-phase current path, and which converts a magnetic flux that is proportional to the U-phase current to a Hall voltage 52*a* and outputs the Hall voltage 52*a* to a signal wire 52*a*. The Hall voltage 52*a* is illustrated in FIG. 5(*a*). The output voltage 52*a* of the Hall element sensor 52 is input to the rectification portion 54. The rectification portion 54 rectifies the output voltage 52*a* and outputs the rectified voltage as a signal 54*a*. The rectification is half-wave rectification or full-wave rectification. The signal 54*a* in a case where half-wave rectification is performed is illustrated in FIG. 5(*c*), and the signal 54*a* in a case where full-wave rectification is performed is illustrated in FIG. 5(*d*).

The output 54*a* is input to the effective value converter 56. The effective value converter 56 determines the mean during one alternating voltage cycle. An output 56*a* of the effective value converter 56 is illustrated in FIG. 5(*e*). The output 56*a* of the effective value converter 56 is input to the endpoint detection portion 58. The endpoint detection portion 58 performs endpoint detection based on the output 56*a*.

Figure 6:
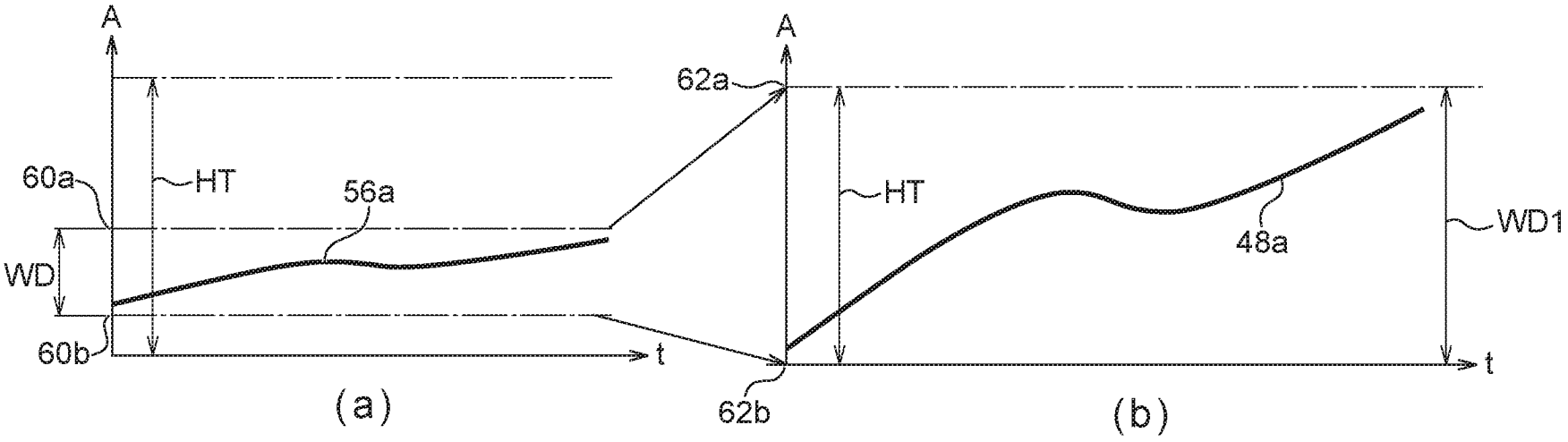
FIG. 6 is a multiple view drawing in which FIG. 6(*a*) is a graph illustrating an output 56*a* of an effective value converter 56 of the comparative example, and FIG. 6(*b*) is a graph illustrating an output 48*a* of an effective value converter 48 of the present embodiment.

A comparison between a processing result of the comparative example and a processing result of the present embodiment is illustrated in FIG. 6. FIG. 6(*a*) is a graph that illustrates the output 56*a* of the effective value converter 56 of the comparative example. FIG. 6(*b*) is a graph that illustrates the output 48*a* of the effective value converter 48 of the present embodiment. In these graphs, the horizontal axis represents time and the vertical axis represents the output voltage of the relevant effective value converter that is converted to a corresponding driving current. Based on FIG. 6, it will be understood that the change in the current increases according to the present embodiment. A range HT in FIG. 6 represents a range within which input to the effective value converters 48 and 56 is possible. A level 60*a* of the comparative example corresponds to a level 62*a* of the present embodiment, and a level 60*b* of the comparative example corresponds to a level 62*b* of the present embodiment.

In the comparative example, a change range WD (=level 60*a*–level 60*b*) of the driving current 56*a* is much smaller than the range HT within which input is possible. According to the present embodiment, the driving current 48*a* is processed by the processing portion 30 so that the change range WD1 (=level 60*a*–level 60*b*) of the driving current 48*a* becomes approximately equal to the range HT within which input is possible. As a result, the change range WD1 of the driving current 48*a* is much larger than the change range WD of the comparative example. According to the present embodiment, even in a case where a change in the torque current is small, the change in the torque current is favorably detected and the accuracy of polishing endpoint detection improves.

Figure 7:
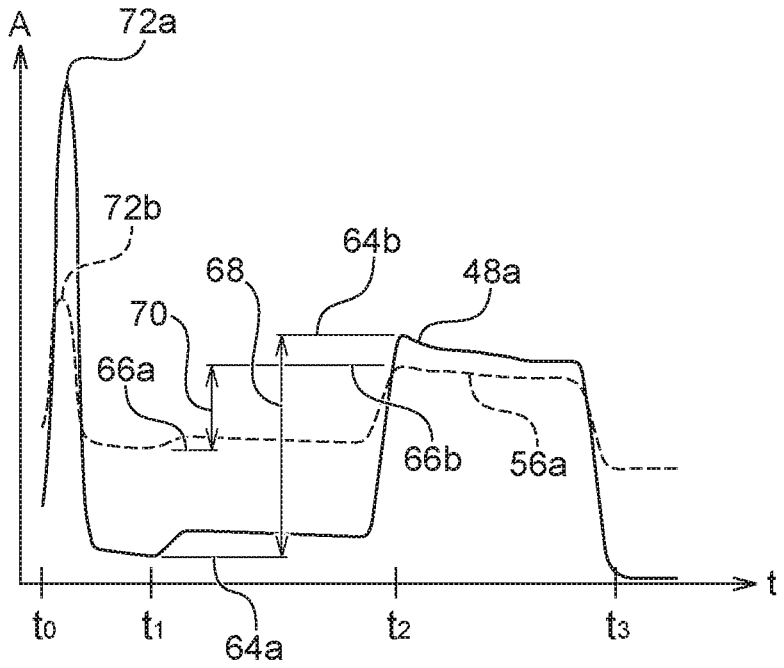
FIG. 7 is a graph illustrating the output 56*a* of the effective value converter 56 of the comparative example, and the output 48*a* of the effective value converter 48 of the embodiment.

Results of processing in the comparative example and the present embodiment are illustrated by separate graphs in FIG. 7 which shows a comparison of the results. FIG. 7 is a graph illustrating the output 56*a* of the effective value converter 56 of the comparative example, and the output 48*a* of the effective value converter 48 of the present embodiment. In the graph, the horizontal axis represents time and the vertical axis represents the output voltage of the relevant effective value converter that is converted to a corresponding driving current. In the present drawing, the polishing target is different to the polishing target in FIG. 6. FIG. 7 shows the manner in which the output voltage of the relevant effective value converter changes from a polishing starting time point t1 until a polishing ending time point t3.

As is apparent from FIG. 7, a change amount in the output 48*a* of the effective value converter 48 of the present embodiment is larger than a change amount in the output 56*a* of the effective value converter 56 of the comparative example. The output 48*a* and the output 56*a* each exhibit a lowest value 64*a* and 66*a*, respectively, at a time t1, and each exhibit a highest value 64*b* and 66*b*, respectively, at a time t2. A change amount 68 (=64*b*–64*a*) in the output 48*a* of the effective value converter 48 is significantly larger than a change amount 70 (=66*b*–66*a*) in the output 56*a* of the effective value converter 56 of the comparative example. Note that, although peak values 72*a* and 72*b* represent current values that are larger than the highest values 64*b* and 66*b*, the peak values 72*a* and 72*b* are ascribable to noise that arises in an initial stage until polishing stabilizes.

Figure 8:
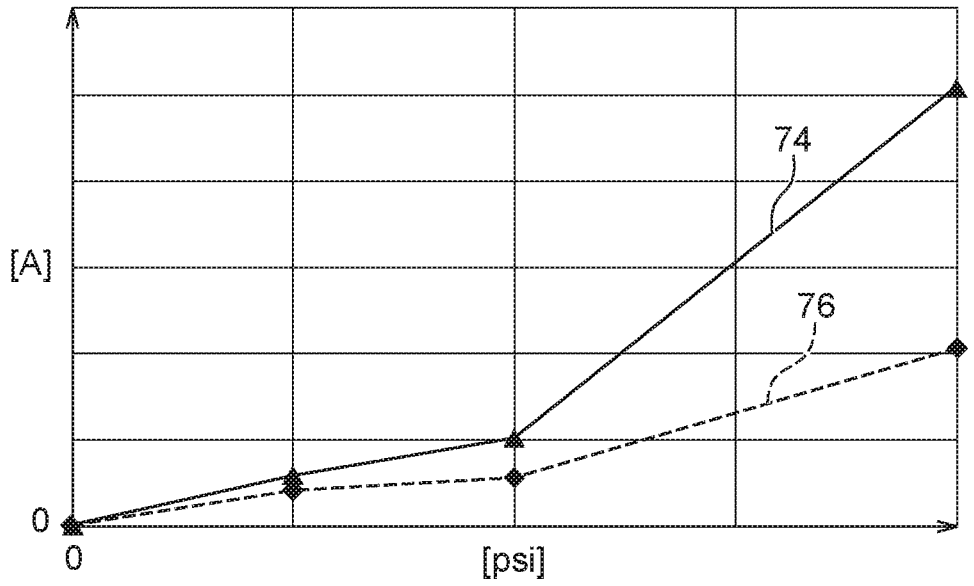
FIG. 8 is a graph illustrating changes in a change amount 70 of the output 56*a* of the comparative example and changes in a change amount 68 of the output 48*a* of the present embodiment with respect to a pressure applied to a semiconductor wafer 18.

The change amounts 68 and 70 illustrated in FIG. 7 depend on a pressure when the semiconductor wafer 18 is pressed against the polishing pad 10 in a state in which the top ring 20 is being rotationally driven by the second electric motor 22. The change amounts 68 and 70 increase as the aforementioned pressure increases. This is illustrated in FIG. 8. FIG. 8 is a graph that illustrates changes in the change amount 70 of the output 56*a* of the comparative example and a change amount 68 of the output 48*a* of the present embodiment with respect to a pressure applied to the semiconductor wafer 18. The horizontal axis in the graph represents a pressure applied to the semiconductor wafer 18, and the vertical axis represents the output voltage of the effective value converter that is converted to a corresponding driving current. A curved line 74 is obtained by plotting the change amount 68 in the output 48*a* of the present embodiment with respect to the pressure. A curved line 76 is obtained by plotting the change amount 70 in the output 56*a* of the comparative example with respect to the pressure. When the pressure is 0, that is, when polishing is not being performed, the current is 0. As will be understood from the present drawing, the change amount 68 in the output 48*a* of the effective value converter 48 of the present embodiment is greater than the change amount 70 in the output 56*a* of the effective value converter 56 of the comparative example, and the difference between the curved line 74 and the curved line 76 is more noticeable as the pressure increases.

Next, control of the amplification portion 40, the offset portion 42, the filter 44 and the second amplification portion 46 by the control portion 50 will be described. The control portion 50 controls amplification characteristics (an amplification factor and a frequency characteristic and the like) of the amplification portion 40, noise removal characteristics (a pass band and attenuation amount of a signal and the like) of the filter 44, subtraction characteristics (a subtraction amount and a frequency characteristic and the like) of the offset portion 42, and amplification characteristics (an amplification factor and a frequency characteristic and the like) of the second amplification portion 46.

The specific control method is as follows. When changing characteristics of the respective portions described above to control the respective portions, the control portion 50 sends data that shows an instruction to change circuit characteristics to each of the above described portions by digital communication (USB (Universal Serial Bus), LAN (Local Area Network), RS-232 or the like).

Each portion that receives the data changes settings relating to the characteristics in accordance with the data. The changing method involves changing settings such as a resistance value of a resistance, a capacitance value of a capacitor, or an inductance of an inductor or the like constituting an analog circuit of the respective portions. Switching a resistance or the like using an analog SW may be mentioned as a specific method for changing. Alternatively, after a digital signal is converted to an analog signal by a DA converter, settings are changed by switching a plurality of resistances or the like by means of an analog signal, or a variable resistance or the like is rotated by a small motor. A method may also be adopted in which a plurality of circuits are provided in advance, and the plurality of circuits are switched.

Various kinds of data are available as the contents of the data that is sent. For example, a method may be adopted in which a number is sent, and the respective portions that receive the number select a resistance or the like that corresponds to the number that is received. Alternatively, a method may be adopted in which a value that corresponds to the size of a resistance value or an inductance is sent, and the size of a resistance value or an inductance is set in detail in accordance with the relevant value.

Methods other than digital communication are also possible. For example, it is also possible to adopt a method in which signal wires are provided that directly connect the control portion 50 and the amplification portion 40, the offset portion 42, the filter 44 and the second amplification portion 46, and resistances and the like inside the respective portions are switched using the signal wires.

Figures 9, 10:
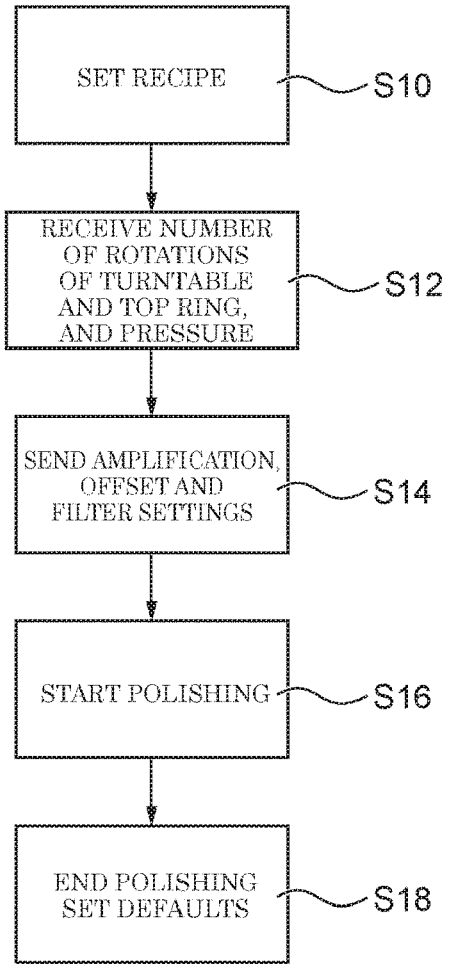
FIG. 9 illustrates an example of settings of an amplification portion 40, an offset portion 42, a filter 44 and a second amplification portion 46.
FIG. 10 is a flowchart illustrating an example of control of respective portions by a control portion 50.

One example in which the respective portions are set by the control portion 50 will now be described referring to FIG. 9. FIG. 9 illustrates an example of setting the amplification portion 40, the offset portion 42, the filter 44 and the second amplification portion 46. In this example, the input range of the effective value converter 48 is from 0 A (ampere) to 100 A, that is, the input range is 100 A. The maximum value of the waveform of the output signal 38*a* of the rectification operation portion 28 is 20 A, and the minimum value is 10 A. That is, the variation width (amplitude) in the output signal 38*a* of the rectification operation portion 28 is not more than 10 A (=20 A−10 A), and the lower limit of the signal 38*a* is 10 A.

In such a case, since the amplitude of the amount of change in the output signal 38*a* is 10 A, and the input range of the effective value converter 48 is 100 A, a setting value 78*a* of the amplification factor of the amplification portion 40 is set to 10 times (=100 A/10 A). As the result of amplification, a maximum value 78*b* of the waveform of the output signal 38*a* is 200 A, and a minimum value 78*c* thereof is 100 A.

With respect to the subtraction amount at the offset portion 42, since 10 A that is the lower limit of the signal 38*a* is amplified by the amplification portion 40 and becomes 100 A, the offset portion 42 subtracts 100 A. Accordingly, a setting value 78*d* for the subtraction amount at the offset portion 42 is −100 A. As the result of the subtraction, a maximum value 78*e* of the waveform of the output signal 38*a* is 100 A and a minimum value 78*f* thereof is 0 A.

In the example illustrated in FIG. 9, with regard to the filter 44, the state thereof does not change from the initial settings, and therefore a setting value 78*g* is left blank. As the result of the filter processing, a maximum value 78*h* of the waveform of the output signal 38*a* is attenuated to a value lower than 100 A in accordance with the filter characteristics, and a minimum value 78*i* of the waveform of the output signal 38*a* is 0 A. This is because, in the case illustrated in FIG. 9, the filter 44 has a characteristic that maintains the output at 0 A when the input is 0 A. The purpose of the second amplification portion 46 is to correct the amount that was attenuated by the filter 44. A setting value 78*j* of the amplification factor of the second amplification portion 46 is set to a value that can correct the amount that was attenuated by the filter 44. As a result of the second amplification, a maximum value 78*k* of the waveform of the output signal 38*a* is 100 A, and a minimum value 78*l* thereof is 0 A.

Next, one example of the control of the respective portions by the control portion 50 will be further described by means of FIG. 10. FIG. 10 is a flowchart illustrating one example of control of the respective portions by the control portion 50. When starting polishing, information relating to a polishing recipe (information that defines polishing conditions with respect to a substrate surface, such as a pressing pressure distribution, a polishing time period and the like) is input to the control portion 50 by an operator of the polishing apparatus 100 or from an unshown management apparatus of the polishing apparatus 100 (step 10).

The reason for using a polishing recipe is as follows. When performing multi-stage polishing processes in succession with respect to a plurality of substrates such as semiconductor wafers, the surface state, such as the film thickness, of each substrate surface is measured before polishing, or between the polishing processes of each stage, or after polishing. This is done so as to feed back values obtained by the measurement and optimally correct (update) the polishing recipe for the next substrate or for a substrate to be polished after an arbitrary number of substrates.

The contents of the polishing recipe are as follows: (1) Information relating to whether or not the control portion 50 is to change settings of the amplification portion 40, the offset portion 42, the filter 44 and the second amplification portion 46. In the case of changing the settings, the communication setting with each portion is enabled. On the other hand, in a case where the settings are not to be changed, the communication setting with each portion is disabled. In a case where the communication setting is disabled, values that are set by default are enabled at each portion. (2) Information relating to the input range of the effective value converter 48. (3) Information indicating a variation width (amplitude) in the output signal 38*a* of the rectification operation portion 28 by means of a maximum value and a minimum value, or information indicating the variation width. This information is also referred to as "torque range". (4) Information relating to settings of the filter 44. For example, in the case illustrated in FIG. 9, the settings are set to the default settings. (5) Information relating to whether or not to reflect polishing information, for example, information relating to the number of rotations of the table in the control.

Next, in accordance with information in the polishing recipe relating to whether or not to reflect polishing information in the control, in a case where the setting is to reflect the polishing information in the control, the control portion 50 receives information regarding the number of rotations of the polishing table 12 and the top ring 20 as well as a pressure to be applied by the top ring 20, from the unshown management apparatus of the polishing apparatus 100 (step 12). The reason for receiving this information is that in some cases ripples arise due to the influence of the pressure, the number of rotations of the table, and a number of rotations ratio between the number of rotations of the table and the number of rotations of the top ring, and it is necessary to perform filter settings in accordance with the ripple frequency.

Next, in a case where the communication setting is enabled, the control portion 50 determines setting values for the amplification portion 40, the offset portion 42, the filter 44 and the second amplification portion 46 in accordance with the polishing recipe and the information received in step 12. The determined setting values are sent to the respective portions by digital communication (step 14). In a case where the communication setting is disabled, the default setting values are set at the amplification portion 40, the offset portion 42, the filter 44 and the second amplification portion 46.

Polishing is started after setting of the relevant setting values at the respective portions finishes. During the polishing the control portion 50 receives a signal from the effective value converter 48 and continues to perform a determination regarding the polishing endpoint (step 16).

If the control portion 50 determines the polishing endpoint based on the signal from the effective value converter 48, the control portion 50 sends information indicating that the polishing endpoint was detected to the unshown management apparatus of the polishing apparatus 100. The management apparatus ends the polishing (step 18). After polishing ends, the default setting values are set at the amplification portion 40, the offset portion 42, the filter 44 and the second amplification portion 46.

According to the present embodiment, because data of three phases is rectified and added, and furthermore, waveform amplification is performed, there is the advantageous effect that a difference in the output of the current that accompanies a torque change increases. Further, since the characteristics of the amplification portion and the like can be changed, the output difference can be further increased. Furthermore, noise is reduced because a filter is used.

Next, an accumulation portion and the difference portion of the present invention will be described using FIG. 11. Hereunder, a processing method with respect to the Hall voltage 32*a* that the current sensor 31*a* outputs that is illustrated in FIG. 2 will be described. The Hall voltages 32*b* and 32*c* that the current sensors 31*b* and 31*c* output are similarly processed.

First, the characteristics of noise will be described with respect to a case where noise that is caused by hardware (a motor) cannot be removed even if a noise filter is used. The number of rotations of the table is, for example, around 60 RPM, and when converted to frequency this is equivalent to approximately 1 Hz. The Hall voltage 32*a* includes noise of a frequency that is lower than that of the number of rotations of the table, that is, noise that is repeated approximately regularly that has a frequency lower than 1 Hz. For example, the Hall voltage 32*a* includes long-period noise with a period of 1 to 15 seconds, that is, 1 to 1/15 Hz when converted to frequency.

Figure 11:
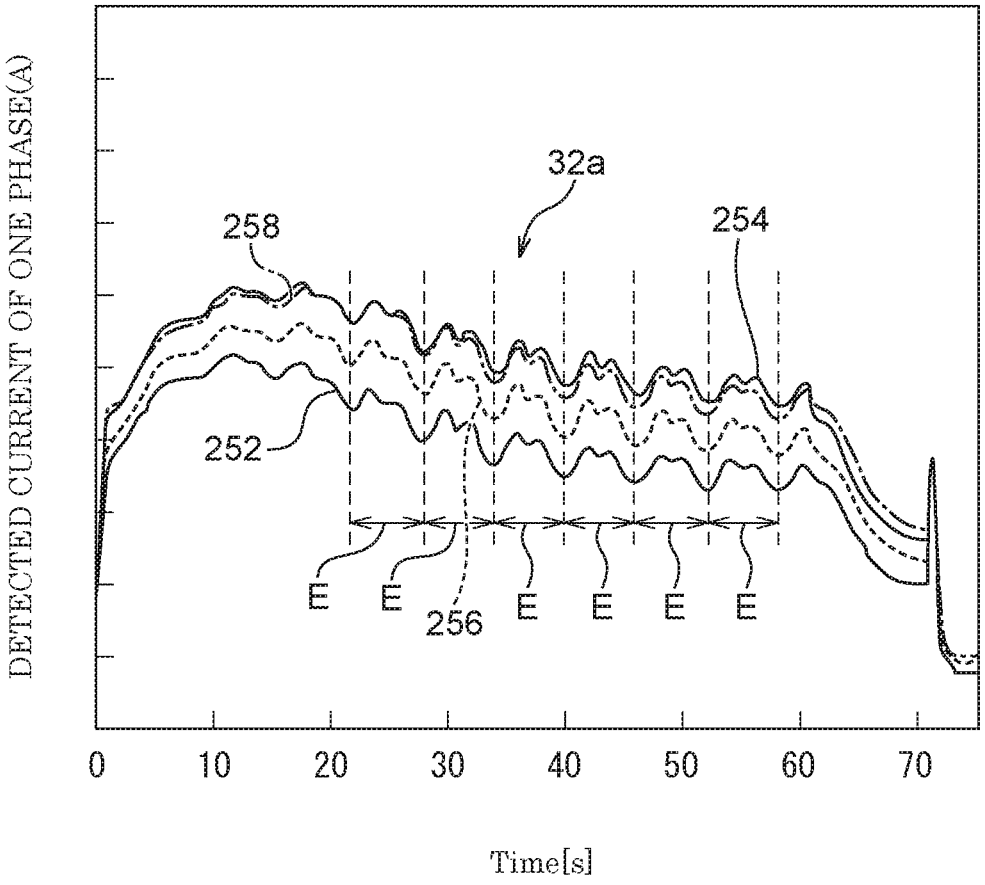
FIG. 11 is a view illustrating characteristics of a current for polishing endpoint detection in the comparative example.
Figure 12:
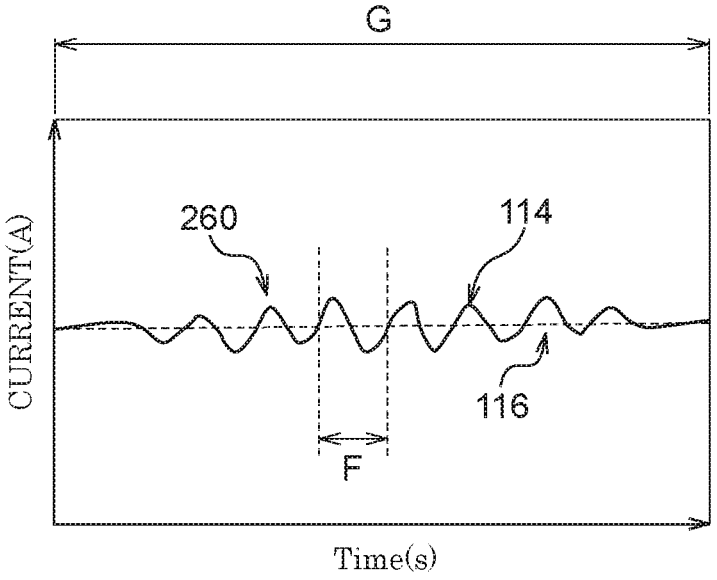
FIG. 12 is an enlarged view illustrating characteristics of a current at a part A in FIG. 11.

This one example is illustrated in FIGS. 11 and 12. FIG. 11 is a view illustrating the characteristics of a current for polishing endpoint detection according to a comparative example. FIG. 11 is a view that illustrates, with respect to each of samples A, B, C and D of four polishing apparatuses, respectively, for which the polishing conditions are the same, transitions in the detected current 32*a* in a case where a current of a specific single phase (for example, the V-phase) is detected and used for polishing endpoint detection as in the conventional technology.

In FIG. 11 (case where a specific single phase is detected), current transitions 252, 254, 256 and 258 are current transitions that correspond to the samples A, B, C and D, respectively. For example, when the current transition 252 corresponding to sample A for which a lower current value is detected and the current transitions 254 and 258 corresponding to samples B and D for which higher current values are detected are compared, it is found that there is a difference between the current values thereof. Further, the current transition 256 corresponding to the sample C is a current that is approximately midway between the current transition 252 and the current transitions 254 and 258. In a case where the current of a specific single phase is detected for polishing endpoint detection in this way, variations arise between the current transitions of the samples A, B, C and D.

However, it is found that, in the current transitions of the samples A, B, C and D, noise having the same tendency that is represented by E sections in FIG. 11 which has a period of approximately 10 seconds repeatedly appears. That is, it is found that the noise indicated by the E sections is repeated.

On the other hand, FIG. 12 is a view of another comparative example which illustrates, in an enlarged form, only portions that are repeated, such as the E sections of the current transitions 252 in FIG. 11. In FIGS. 11 and 12, the horizontal axis represents the time axis and the vertical axis represents a current value for polishing endpoint detection. However, in FIG. 12, the current transition 260 is shown in a manner in which the current transition 260 is separated into noise 114 that is caused by hardware (a motor) and a component 116 obtained after removing the noise 114 from the current transition.

An F section in FIG. 12 represents an interval that corresponds to one rotation of the table 12. The length of a time period of a G section in FIG. 12 corresponds to the length of a time period of the E section in FIG. 11. The length of the time period of the G section in FIG. 12 corresponds to approximately 10 rotations of the table 12, and it is thus found that long-period noise exists.

In the case of removing such noise using a low-pass filter, it is necessary for the cut-off frequency of the low-pass filter to be 1 to 1/15 Hz or less. However, when such a low-pass filter is used, the usage thereof affects changes in the frictional force that are the object of detection. This is because changes in the frictional force have a low frequency.

Figure 13:
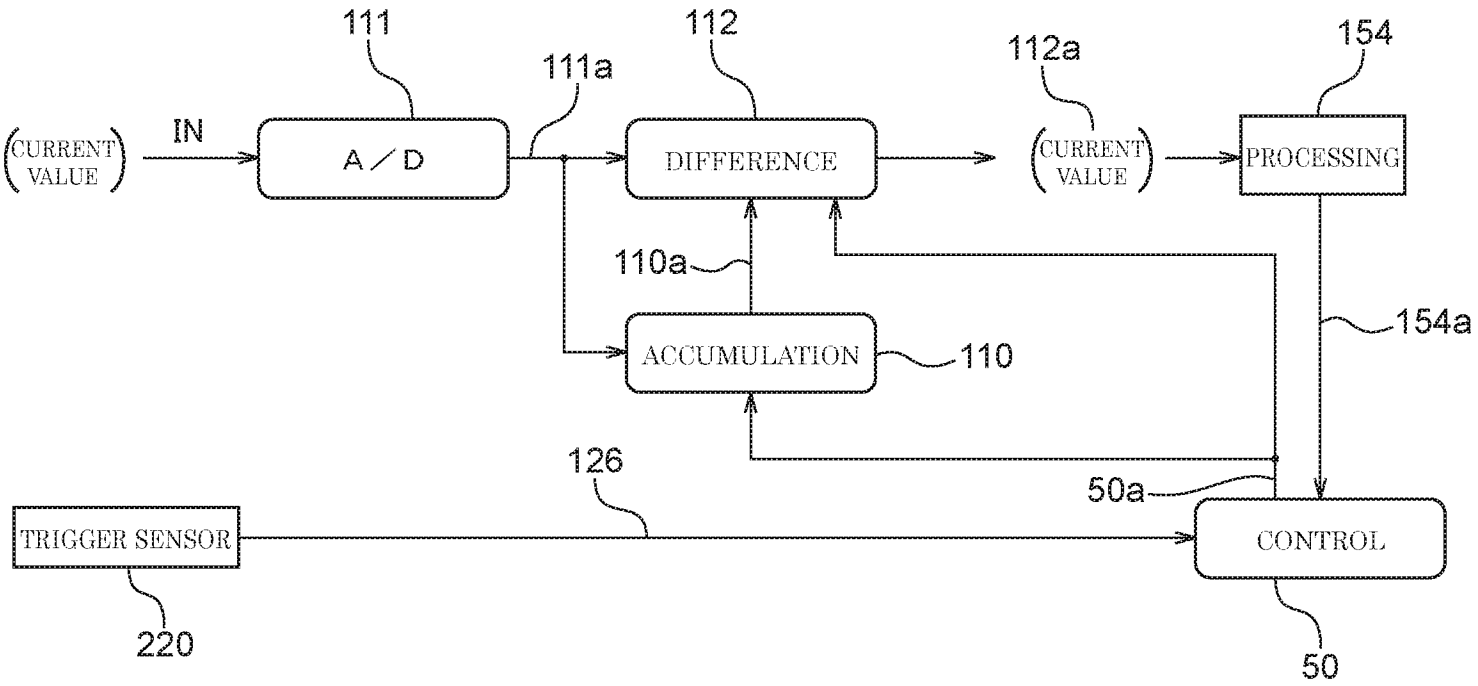
FIG. 13 is a block diagram of a system that removes long-period noise.

Therefore, in the present invention, a difference is used to remove the noise, and a low-pass filter is not used. Specifically, as shown in FIG. 13, the polishing apparatus 100 includes an A/D converter 111 that subjects an inputted current value (value at a stage prior to the rectification operation portion 28, the processing portion 30 or the effective value converter 48) IN to analog-digital conversion (A/D conversion), and an accumulation portion 110 that accumulates a current value 111*a* that was subjected to A/D conversion, for a prescribed interval. The accumulated data serves as reference data during processing that is performed after the data is accumulated. The polishing apparatus 100 has a difference portion 112 that determines a difference between the current value 111*a* that underwent A/D conversion that was input during an interval that is different to the prescribed interval, and an accumulated current value 110*a* that the accumulation portion 110 outputs. A difference 112*a* that the difference portion 112 outputs is processed as mentioned previously by the rectification operation portion 28, the processing portion 30 or the effective value converter 48 that is provided at a subsequent stage to the difference portion 112 among the rectification operation portion 28, the processing portion 30 and the effective value converter 48.

A processing portion 154 in FIG. 13 represents the rectification operation portion 28, the processing portion 30 or the effective value converter 48 that is provided at a subsequent stage to the difference portion 112 among the rectification operation portion 28, the processing portion 30 and the effective value converter 48.

In addition, the polishing apparatus 100 has the control portion (endpoint detection portion) 50. A signal 154*a* that is obtained when the processing portion 154 processes the difference 112*a* that the difference portion 112 outputs is input to the control portion 50, and the control portion 50 detects a polishing endpoint that indicates the end of polishing of the surface of the polishing target based on a change in the signal 154*a*. In this case, the prescribed interval is determined in accordance with the period of the noise that it is desired to remove. For example, in the case illustrated in FIGS. 11 and 12, the prescribed interval is caused to match the period of the noise that it is desired to remove, and is thus the length of the E section, that is, a time period in which the table 12 rotates 10 times. By this means, long-period noise that is repeated approximately regularly can be eliminated. The difference portion 112 may be inserted at the stage prior to any one of the rectification operation portion 28, the processing portion 30 and the effective value converter 48.

Figure 14:
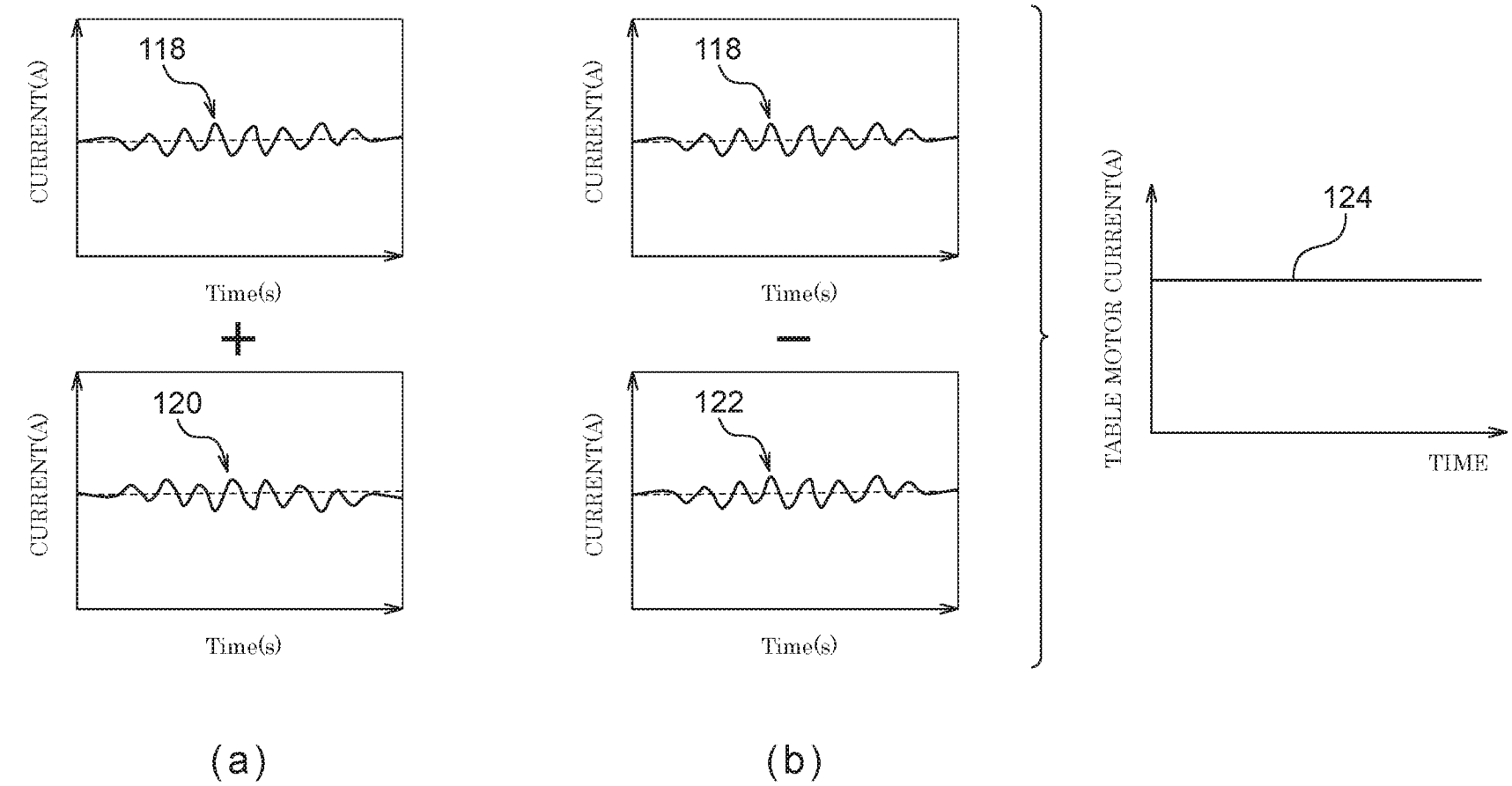
FIG. 14 is a multiple view drawing illustrating the manner in which a difference portion 112 determines a difference.

Methods for determining a difference at the difference portion 112 are illustrated in FIG. 14. In FIG. 14, the horizontal axis represents the time axis, and the vertical axis represents a current value for polishing endpoint detection. As shown in FIG. 14(*a*), one method is a method that adds the data to data of an opposite phase to eliminate unevenness, that is, adds a current value 120 obtained by reversing the sign of the accumulated current value to a current value 118 detected in an interval that is different to the prescribed interval, to thereby remove noise. As another method, as shown in FIG. 14(*b*), a method is available which removes noise by subtracting equiphase data to eliminate unevenness, that is, subtracts an accumulated current value 122 from the current value 118 detected in an interval that is different to the prescribed interval. These methods perform substantially equivalent processing to each other, and the same result is obtained as a current value 124 that is illustrated in FIG. 14(*c*).

Note that, because the current value 118 and the current value 120 are measured in different time periods, the levels of the current values are different. However, to facilitate the diagrammatic representation, in FIG. 14 the levels of the current values are shown as being substantially the same level. The levels of the current values are illustrated more precisely in FIG. 15.

The accumulation portion 110 accumulates a current value for at least one rotation of at least one of the polishing table and the holding portion. In the present embodiment, the accumulation portion 110 accumulates a current value for three rotations of the polishing table 12. That is, the prescribed interval is an interval that is required for one of the polishing table and the holding portion to make one rotation or more. In the present embodiment, the prescribed interval is an interval in which the polishing table 12 makes three rotations.

In a case where the rotational speeds of the polishing table and the holding portion are different, when the faster rotational speed is taken as "a" and the slower rotational speed is taken as "b", the prescribed interval may be an interval required for the component with the slower rotational speed between the polishing table and the holding portion to make (b/(a−b)) rotations.

In the present embodiment, the accumulation portion 110 accumulates a current value for at least one rotation. This is because there are many cases in which the noise that is taken as an object of the present invention has a long period that extends for an interval of one rotation or more of the polishing table and the holding portion. The optimal number of rotations for which data is to be used depends on the polishing conditions (state of a film on the wafer, the material, the number of rotations of a motor and the like). As one example, in some cases, after the polishing table and the holding portion have rotated a number of times, a period that it takes for the polishing table and the holding portion to return relatively to the original positional relationship therebetween is preferable as the prescribed interval. A period that it takes for the polishing table and the holding portion to return relatively to the original positional relationship therebetween is an interval that is necessary in order for the component with the slower rotational speed among the polishing table and the holding portion to perform (b/(a−b)) rotations.

In the present embodiment, the number of rotations of the polishing table is 60 rotations per minute, and the number of rotations of the holding portion is 80 rotations per minute. In this case, when the polishing table rotates three times, the holding portion rotates four times during the same period and the relative rotational positions of the polishing table and the holding portion return to the original positions thereof.

Figure 15:
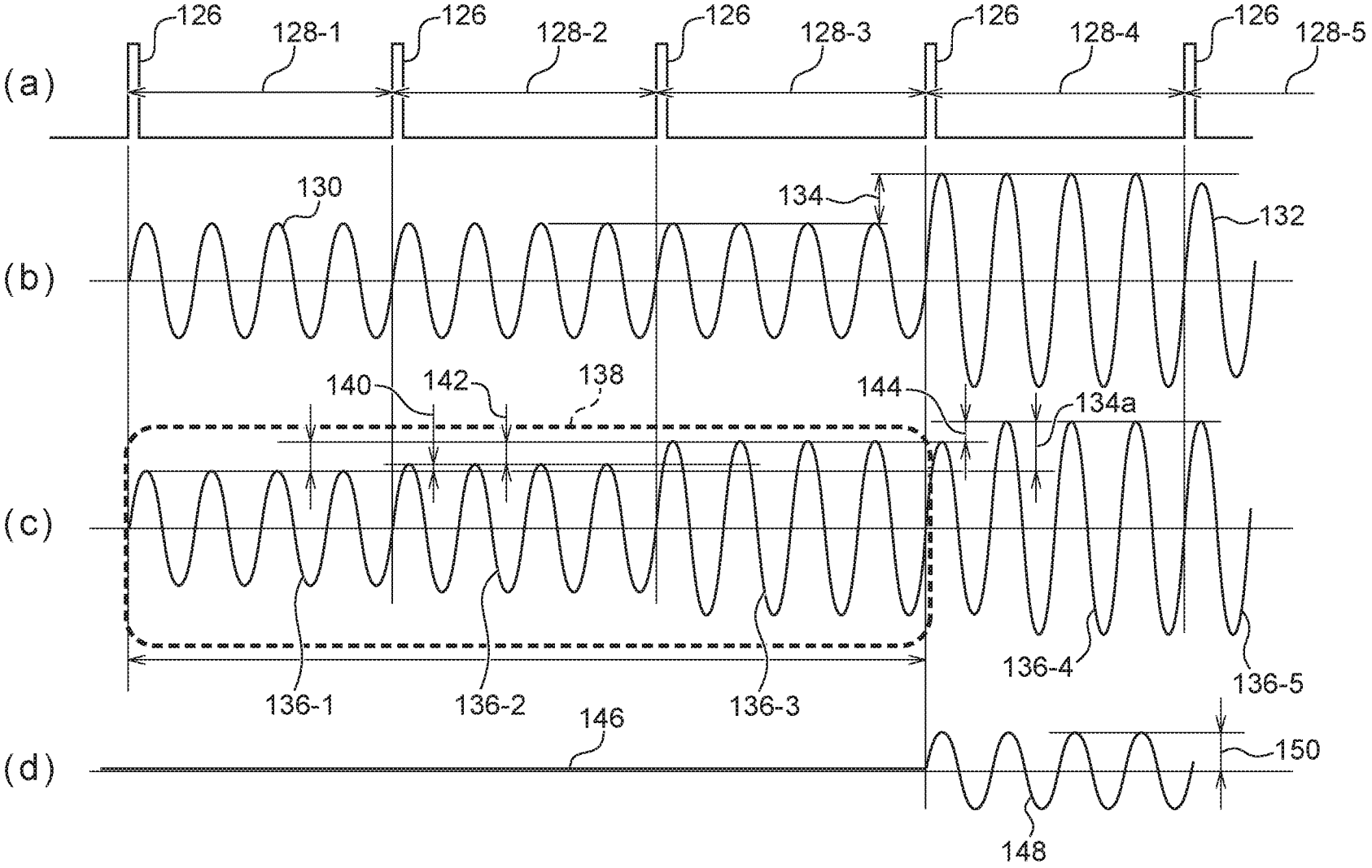
FIG. 15 is a timing chart for describing details of data that an accumulation portion 110 accumulates and a processing result obtained by the difference portion 112.

FIG. 15 is a multiple view drawing for describing data which the accumulation portion 110 accumulates, and the details of a processing result obtained by the difference portion 112. FIG. 15(*a*) illustrates a trigger signal 126 that a trigger sensor (position detection portion) 220 that detects a rotational position of the polishing table outputs. The horizontal axis represents time. The prescribed interval is set taking a detected position as a reference. An interval 128 is a time period required for the table 12 to perform one rotation. Since noise that is caused by hardware is generated by a motor, correction is performed in units of three rotations by utilizing a trigger which is generated each time the motor performs one rotation. The reason for performing correction in units of three rotations is that, in the case of the numbers of rotations in the present embodiment, when the polishing table rotates three times, during that period the holding portion rotates four times and the relative rotational positions of the polishing table and the holding portion return to their original positions. In a case where the numbers of rotations of the polishing table and the holding portion are different to the present embodiment, it is possible to perform correction in units of a number of rotations that is different to three rotations.

As shown in FIG. 1, the trigger sensor 220 includes a proximity sensor 222 that is disposed on the polishing table 12, and a dog 224 that is disposed outside the polishing table 12. The proximity sensor 222 is attached to the undersurface (face on which the polishing pad 10 is not attached) of the polishing table 12. The dog 224 is disposed outside the polishing table 12 so as to be detected by the proximity sensor 222. Note that, the positional relationship between the trigger sensor 220 and the dog 224 may also be the reverse of the above described positional relationship. The trigger sensor 220 outputs the trigger signal 126 that indicates that the polishing table 12 has performed one rotation based on the positional relationship between the proximity sensor 222 and the dog 224. Specifically, the trigger sensor 220 outputs the trigger signal 126 to the control portion 50 in a state in which the proximity sensor 222 and the dog 224 are closest to each other.

Various types of sensors can be utilized as the trigger sensor. For example, an alternating current magnetic field (magnetic field) is produced by a detection coil inside the proximity sensor 222. When a detection object (metal: dog 224) approaches the magnetic field, an induced current (eddy current) flows through the detection object due to electromagnetic induction. Because of this current, the impedance of the detection coil changes and oscillation stops, whereby the detection object is detected. In the case of generating a DC (direct current) magnetic field in the trigger sensor, a change in the magnetic field that arises when metal passes over the sensor is detected by a detection coil.

One trigger signal is input each time the table makes one rotation, and reference data of an opposite phase to be added or the like is acquired. The following effect is obtained when a trigger sensor is used. Because there is an error in the rotational frequency of the motor of the table or the like, a lag occurs in a case where the polishing time period is long. By using a trigger sensor, it is possible to absorb rotational irregularities and rotational errors, and eliminate time errors between the reference data of the opposite phase and the data that is to be corrected.

The control portion 50 controls an accumulation start timing and a difference start timing based on the trigger signal 126 that is output from the trigger sensor 220. For example, after polishing starts, the accumulation portion 110 receives the trigger signal 126 from the trigger sensor 220 as a signal 50*a* from the control portion 50, and adopts, as the accumulation start timing, a timing at which the trigger signal 126 has been received a predetermined number of times. Further, after polishing starts, the difference portion 112 receives the trigger signal 126 from the trigger sensor 220 as the signal 50*a* from the control portion 50, and adopts, as the difference start timing, a timing at which the trigger signal 126 has been received a predetermined number of times.

In the present embodiment, accumulation at the accumulation portion 110 is started upon the trigger signal 126 as the accumulation start timing being output, accumulation is performed during a period in which the table 12 rotates three times, and the accumulation ends when a fourth trigger signal 126 is output. When the fourth trigger signal 126 is output, the accumulation ends, and calculation of a difference is started at the difference portion 112. The relation between the polishing starting time point and the accumulation start timing and difference start timing is further described later.

Note that, a time delay may also be provided between the trigger signal 126 and the accumulation start timing and difference start timing. For example, the accumulation portion 110 may adopt a timing at which a predetermined time period has passed after the trigger signal 126 is output from the trigger sensor 220 as the accumulation start timing. Further, a timing at which a predetermined time period has passed after the trigger signal 126 is output from the trigger sensor 220 may be adopted as the difference start timing. By this means, accumulation or determination of a difference can be started from a specific position on the rotary table 12. Here, it is assumed that the predetermined time period is set in advance as a parameter.

In the present embodiment the predetermined time period is 0 seconds. That is, when the trigger signal 126 is output, accumulation and determination of a difference are started. In a case where the predetermined time period is not 0 seconds, accumulation and determination of a difference are started at a delayed timing relative to the trigger signal 126.

FIG. 15(*b*) illustrates a table current 130 that is detected at a time at which it is assumed that noise caused by hardware (a motor) is not present, and other noise is also not present. FIG. 15(*b*) illustrates the output (for one phase) of one Hall sensor. In FIG. 15(*b*), the reason that the table current 130 forms a large number of sinusoidal waves (four sinusoidal waves in FIG. 15(*b*)) during an interval 128 in which the table 12 makes one rotation is that although the number of rotations of the table 12 is approximately one during a one second period, the table current 130 has a frequency corresponding to the switching frequency of the table motor. In FIGS. 15(*b*) to 15(*c*), to facilitate the description, it is assumed that the number of sinusoidal waves of the table current 130 during a period in which the table 12 makes one rotation is four.

In the present embodiment, after polishing has started, after the table 12 makes several rotations and the polishing state is stable (accumulation start timing), the accumulation portion 110 accumulates a current during a period in which the table 12 makes an initial three rotations (period from a first rotation 128-1 to a third rotation 128-3). The accumulation portion 110 accumulates the inputted current in a memory that the accumulation portion 110 includes. The difference portion 112 determines a difference by subtracting the accumulated first rotation 128-1 to the third rotation 128-3 from data for the fourth rotation 128-4 (difference start timing) and onward of the table 12.

Specifically, the difference portion 112 subtracts data for the first rotation 128-1 from data for the fourth rotation 128-4, subtracts data for the fifth rotation 128-5 from data for the second rotation 128-2, subtracts data for the third rotation 128-3 from data for the sixth rotation 128-6, and subtracts data for the first rotation 128-1 from data for the seventh rotation 128-7 and repeats the subtraction processing in the same manner thereafter. As described above in the present embodiment, the data for the first rotation 128-1 to the third rotation 128-3 that serves as a reference when subtracting is acquired in the initial stage of polishing. However, the invention of the present application is not limited to this method, and for example a method may also be adopted in which data for an initial stage of polishing that is previously acquired in polishing of a different wafer is registered in advance. It is also possible to load previously acquired data into the accumulation portion when starting polishing, and use the loaded data as reference data at the time of subtraction.

The current 130 from the first rotation 128-1 up to around the third rotation 128-3 in FIG. 15(*b*) is a current at a time that a change does not arise in friction between the polishing pad 10 and the wafer 18, and is a constant amplitude. A difference in current between a current 132 from the fourth rotation onwards when polishing proceeds and a change arises in the friction and the current 130 appears as a difference 134 (corresponds to a polishing amount) between the amplitudes of the current.

FIG. 15(*c*) illustrates a current 136 that is detected at a time at which it is assumed that noise caused by hardware (a motor) is present, and other noise is not present. In comparison to the current 130 in FIG. 15(*b*), as described later, a change (noise) due to the influence of rotation of a motor (equipment) arises in the current 136. FIG. 15(*c*) illustrates the output of one Hall sensor.

The accumulation portion 110 accumulates currents 136-1, 136-2 and 136-3 in a period during which the table 12 makes three initial rotations. The difference portion 112 determines a difference by subtracting the accumulated currents 136-1, 136-2 and 136-3 for the first rotation 128-1 to the third rotation 128-3 from currents 136-4, 136-5 . . . for the fourth rotation 128-4 onward of the table 12 as described above.

When FIG. 15(*b*) and FIG. 15(*c*) are compared, it is found that there is the following tendency in the current 138 of the first rotation 128-1 to the third rotation 128-3. In FIG. 15(*c*), a difference 140 arises between the amplitudes of the current 136-1 and the current 136-2, and a difference 142 arises between the amplitudes of the current 136-2 and the current 136-3. This is because a change (noise) arises that is due to the influence of rotation of a motor (equipment).

The difference 140 between the amplitudes of the current 136-1 and the current 136-2, and the difference 142 between the amplitudes of the current 136-2 and the current 136-3 are repeated at almost the same values from the fourth rotation 18-4 onwards also. The invention of the present application utilizes the fact that a change (noise) that arises due to the influence of rotation of a motor (equipment) is repeated at the same size after every predetermined number of rotations. The number of rotations after which the change (noise) is repeated differs depending on the polishing conditions and the like.

Note that, when the difference 134 between the amplitudes of the current 130 and the current 132 in FIG. 15(*b*) is compared with the difference 144 between the amplitudes of the current 136-3 and the current 136-4 in FIG. 15(*c*), it is found that the amplitude difference 144 is smaller. That is, the apparent change in the polishing amount due to the influence of rotation of the motor has decreased. Accordingly, in a case in which noise is not removed in the manner of the present application, endpoint detection is difficult. The fact that the amplitude difference 144 decreases also causes the following problem. Normally, the motor current 136 is converted to a direct current by signal processing at a subsequent stage to thereby monitor a change in the polishing amount. If the amplitude difference 144 decreases, a change when the current is converted to a direct current also decreases, and there is the problem that endpoint detection is difficult when performing endpoint detection based on the size of the change amount. The present application removes noise, and therefore the change amount increases. This point will be described next.

FIG. 15(*d*) illustrates outputs 146 and 148 of the difference portion 112 after determination of a difference is performed by the difference portion 112, that is, after noise was removed. The determination of a difference is performed based on the trigger signal 126 illustrated in FIG. 15(*a*). Each time the trigger signal 126 is input, the timing for sampling of data in the A/D converter 111 is reset, and a data acquisition timing in the difference portion 112 and the A/D converter 111 is adjusted. By means of this adjustment, it is possible to suppress a lag in data acquisition in the difference portion 112 to a period that is less than a period that the A/D converter 111 requires to perform a single sampling. The output 146 until the third rotation 128-3 in table 12 is 0. The output of the difference portion 112 with respect to data matching the accumulated data is 0. The output 148 from the fourth rotation 128-4 onwards is not 0 because of a change in the polishing amount.

A case in which the difference portion 112 is disposed at the stage prior to the rectification operation portion 28 will now be described. In this case, the output 148 for the fourth rotation 128-4 onward includes a change in the polishing amount and unshown noise that is not caused by the motor. The unshown noise is removed by a processing portion 30 (shown in FIG. 2) at the subsequent stage. In the output 148 for the fourth rotation 128-4 onwards, a portion of a change in the current value that is due to a cause other than noise generated by the motor remains as the amplitude 150 of the output 148. The amplitude 150 of the output 148 is the same size as the amplitude difference 134 shown in FIG. 15(*a*). Accordingly, noise generated by the motor is eliminated, and only the change in the polishing amount can be accurately detected.

It is also possible to store an algorithm that is used in the present embodiment in an accumulation portion (memory or HDD) inside a calculation unit equipped with a CPU, and to execute the algorithm with the CPU. In the present embodiment, a configuration is adopted in which the accumulation portion 110 accumulates current values of at least two phases that are detected by Hall sensors for a prescribed interval prior to rectifying the current values, the difference portion 112 determines a difference with respect to each of the currents of at least two phases, and the polishing apparatus rectifies current detection values of at least two phases that are differences that the difference portion 112 outputs. However, the present invention is not limited to this configuration, and determination of a difference may also be performed after rectification. For example, a configuration may also be adopted in which the accumulation portion 110 accumulates, for a prescribed interval, current values of at least two phases that are output by the rectification operation portion, the difference portion 112 determines a difference for each of the currents of at least two phases, and the endpoint detection portion detects a polishing endpoint that indicates the end of polishing of the surface of the polishing target based on a change in the difference that the difference portion 112 outputs.

Figure 16:
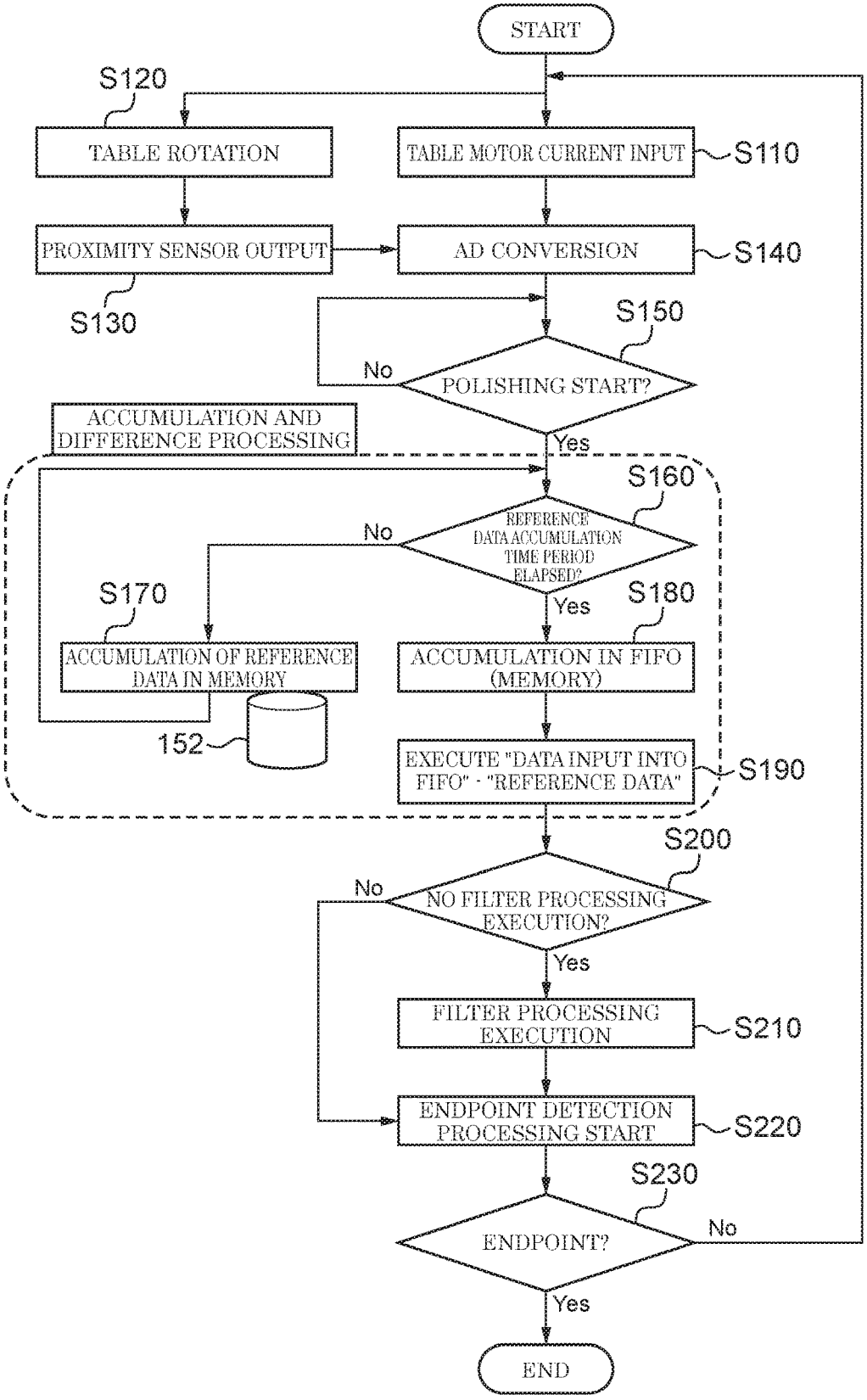
FIG. 16 is a flowchart illustrating an example of control of respective portions by the control portion 50.

Next, one example of control by the control portion 50 in the present embodiment will be further described referring to FIG. 16. FIG. 16 is a flowchart that illustrates one example of control of the respective portions by the control portion 50. In the present flow, the accumulation portion 110 collects reference data during polishing, that is, acquires reference data immediately after polishing starts.

With regard to setting of a time period for accumulating reference data, the control portion 50 that has a CPU (central processing unit) determines the time period by performing a calculation as described previously based on a ratio between the number of rotations of the table motor and the number of rotations of the top ring motor. Information relating to the number of rotations that corresponds to the required polishing step amount is acquired prior to polishing from a CMP main unit side. In this case, the reason for acquiring information in polishing step amounts is that in the case of performing continuous polishing while changing polishing conditions or the like, each time the polishing conditions change, the number of table rotations or the pad pressure changes and the reference data also changes, and therefore the polishing step is regarded as a different polishing step. The CMP main unit side and the control portion 50 may also be integrated together. In this case, the required information is passed between the CMP main unit side and the control portion 50 through a shared memory or the like. In a case where the CMP main unit side and the control portion 50 are integrated together, there is the advantage that a time difference between two CPU processes that arises due to the fact that a CPU on the CMP main unit side and a CPU on the control portion 50 side are separate is minimized.

When the user issues an instruction (that is, from the CMP apparatus side) to start measurement, the control portion 50 causes the table to rotate (S120), and the Hall sensor 31 inputs the table motor current value to the A/D converter 111 (S110). When the table 12 starts to rotate, the proximity sensor begins to output a signal (S130). The output of the proximity sensor is input to the A/D converter 111 and is utilized to adjust the timing of A/D conversion using a digital circuit (unshown) that is an FPGA (field-programmable gate array) or the like. The output of the proximity sensor is used to reset the data inside the A/D converter 111 and to match the timings for taking in data. Thereafter, the A/D converter 111 subjects the table motor current value to A/D conversion (S140).

The control portion 50 thereafter waits for an instruction to start polishing from the user (S150). When the user issues an instruction to start polishing, the control portion 50 resets a timer that is provided therein, and thereafter uses the timer to determine whether or not a predetermined time period for accumulating reference data (that is, data for three rotations of the table) has elapsed (S160). If the reference time period has not elapsed, the control portion 50 causes reference data to be accumulated in the memory 152 of the accumulation portion 110 (S170). From that time onwards, table motor current values are accumulated and subjected to difference processing in accordance with information from the proximity sensor. The reason for this is to cause the start of the respective data items to match. The arithmetic processing is, specifically, performed with respect to digitized data in the CPU.

When the reference time period elapses, accumulation by the accumulation portion 110 ends. The table motor current values are accumulated in a FIFO memory (first-in first-out memory) of the difference portion 112 (S180). In a FIFO memory, data that is stored first is thereafter fetched first and simultaneously deleted. As described in the foregoing, to remove noise, the difference portion 112 performs a subtraction operation, that is, "data inputted into FIFO"—"reference data" (S190).

Next, the control portion 50 determines whether or not to execute processing in the processing portion 30 in FIG. 2, that is, filter processing (S200). If there is an instruction to perform the processing from the user, the control portion 50 executes the filter processing (S210). If there is no instruction to perform the processing from the user, the filter processing is not executed. Thereafter, the control portion 50 starts endpoint detection processing based on the output of the difference portion 112 (S220). Next, whether or not the endpoint has been detected is determined (S230). If the endpoint is not detected, the operation returns to the beginning of the steps and the control portion 50 causes the table to continue to rotate (S120), and the Hall sensor 31 inputs a table motor current value to the A/D converter 111 (S110).

Figure 17:
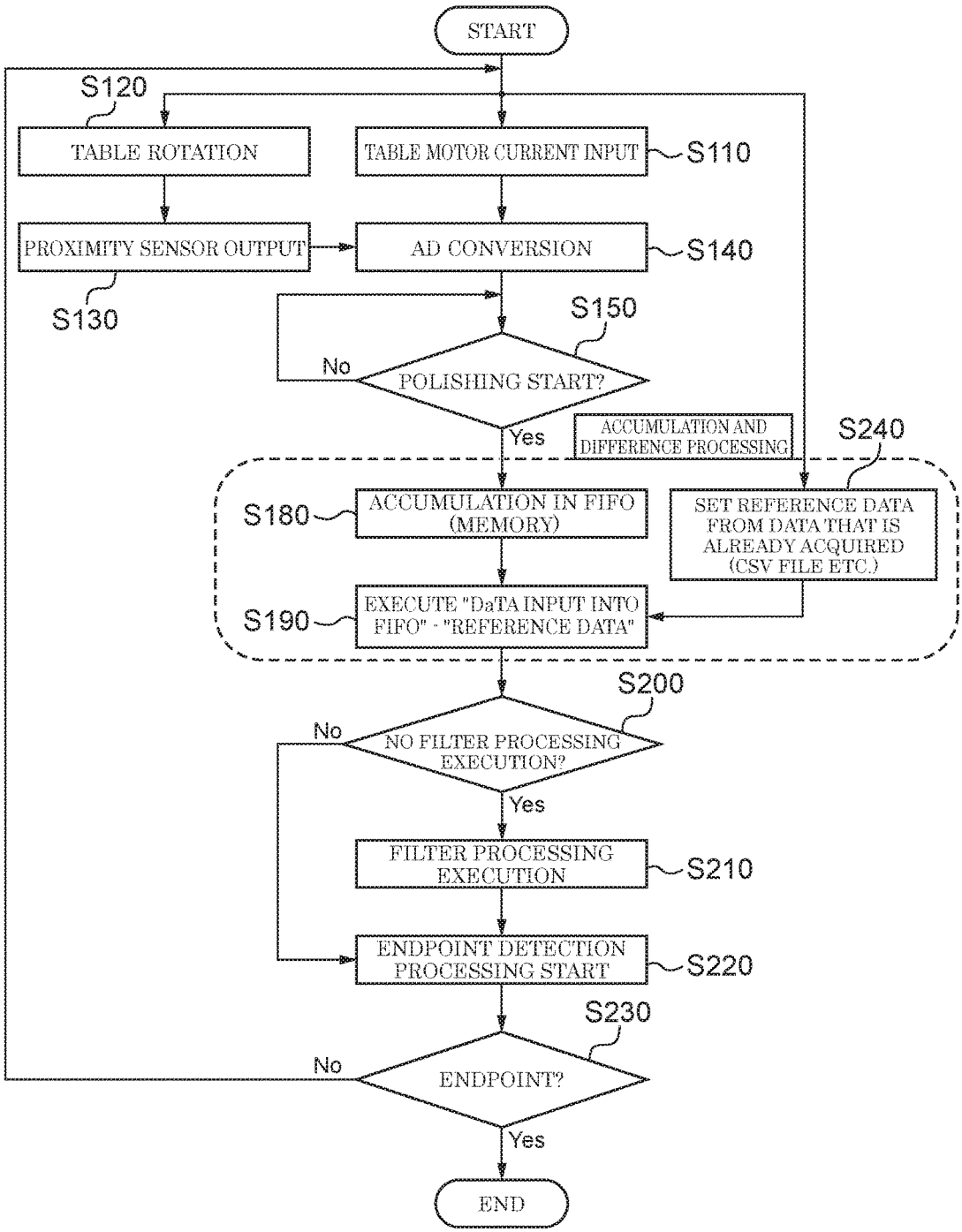
FIG. 17 is a flowchart illustrating an example of control of respective portions by the control portion 50.

Next, a different example of control by the control portion 50 in the present embodiment will be described using FIG. 17. FIG. 17 is a flowchart illustrating an example of control of the respective portions by the control portion 50. In the present flow, reference data is set in the accumulation portion 110 before polishing. That is, reference data is acquired in advance during separate polishing under similar polishing conditions, and the accumulation portion 110 utilizes that data.

With regard to the setting of a time period for accumulating reference data, as described previously, the control portion 50 determines the time period by performing a calculation based on a ratio between the number of rotations of the table motor and the number of rotations of the top ring motor. Information relating to the number of rotations that corresponds to the required polishing step amount is acquired prior to polishing from the CMP main unit side. In a case where the CMP main unit side and the control portion 50 are integrated together, the required information is passed between the CMP main unit side and the control portion 50 using a shared memory or the like.

When the user issues an instruction to start measurement, the control portion 50 causes the table to rotate (S120), and the Hall sensor 31 inputs the table motor current value to the A/D converter 111 (S110). From among a plurality of sets of reference data that have already been acquired, the control portion 50 sends reference data that matches the polishing conditions to the accumulation portion 110, and the accumulation portion 110 sets the reference data in a data format such as a CSV file in a memory inside the accumulation portion 110 (S240).

When the table starts to rotate, the proximity sensor begins outputting a signal (S130). The output of the proximity sensor is input to the A/D converter 111 and is utilized to adjust the timing of A/D conversion. The output of the proximity sensor is utilized for resetting data inside the A/D converter 111 and also to match the timings for taking in data. Thereafter, the A/D converter 111 subjects the table motor current value to A/D conversion (S140).

The control portion 50 thereafter waits for an instruction to start polishing from the user (S150). When the user issues an instruction to start polishing, the table motor current values are subjected to difference processing in accordance with information from the proximity sensor. The reason for this is to cause the start of the respective data items to match. The processing is, specifically, subjecting digitized data to arithmetic processing in the CPU.

The table motor current values are accumulated in the FIFO memory of the difference portion 112 (S180). To remove noise, the difference portion 112 performs a subtraction operation "data inputted into FIFO"—"reference data" as described above (S190).

Next, the control portion 50 determines whether or not to execute processing in the processing portion 30 in FIG. 2, that is, filter processing (S200). In a case where there is an instruction to perform the processing from the user, the control portion 50 executes the filter processing (S210). If there is no instruction to perform the processing from the user, the filter processing is not executed. Thereafter, the control portion 50 starts endpoint detection processing based on the output of the difference portion 112 (S220). Next, whether or not the endpoint has been detected is determined (S230). If the endpoint is not detected, the operation returns to the beginning of the steps and the control portion 50 causes the table to continue to rotate (S120), and the Hall sensor 31 inputs a table motor current value to the A/D converter 111 (S110).

Note that, although in the present embodiment the accumulation portion and the difference portion are applied to a case of rectifying the table current and the like, the accumulation portion and the difference portion can also be applied to a case in which current values are not rectified, and similar effects are obtained. In the case of these processing methods, accumulation and determination of a difference are each performed prior to effective value conversion. A DC component that is generated by effective value conversion is not included in the data prior to effective value conversion. In the case of utilizing data after effective value conversion, because the data includes a DC component it is difficult to generate data of the opposite phase and perform subtraction. This is because the amplitude of the data is decreased by effective value conversion.

After effective value conversion is executed, moving average processing and differential processing are performed by the endpoint detection portion 58 to carry out endpoint detection.

Note that, since the method described in the present embodiment is a method that cancels out the influence of equipment that is imparted to a frictional change during polishing, this method is not limited to application to measurement of a change in a table motor current that is described above, and can also be applied to measurement of a change in torque itself.

In this connection, the detection accuracy can also be further enhanced by combined use of the sensor that measures a table motor current value in this application and a sensor that utilizes another method. It is possible to combine use of the sensor of this application with an eddy-current sensor or an optical sensor. Two favorable examples are described hereunder.

Example 1

In a metal polishing process for a material in which tungsten (W) is included in a metal film, a sensor that measures a table motor current value and an eddy-current sensor are used in combination. In this case, a boundary between the tungsten (W) film and a barrier film is detected by the sensor that measures the table motor current value. Since the eddy-current sensor is affected by a resistance value of the material overall that exists in the film thickness direction of the wafer, in a case where resistance values in the tungsten film and the barrier film are close to each other, it is difficult for a change to arise in a detection value of the eddy-current sensor at the boundary between the tungsten film and the barrier film. On the other hand, because the sensor that measures the table motor current value performs endpoint detection by detecting friction on the polishing surface, the sensor is suitable for detecting the boundary between the tungsten film and barrier film since a waveform change may appear at a boundary point of the barrier film.

Example 2

In an oxide film polishing process for a material in which an oxide film is included in a film, an optical sensor and a sensor that measures a table motor current value are used in combination. Preferably, after film thickness detection is performed by the optical sensor, a location at which the film quality changes is detected by the sensor that measures the table motor current value.

Note that, because the present invention is suitable for eliminating noise that arises for a fixed period, it is also possible to effectively apply the present invention to eliminating noise that arises during in situ dressing.

Figure 18:
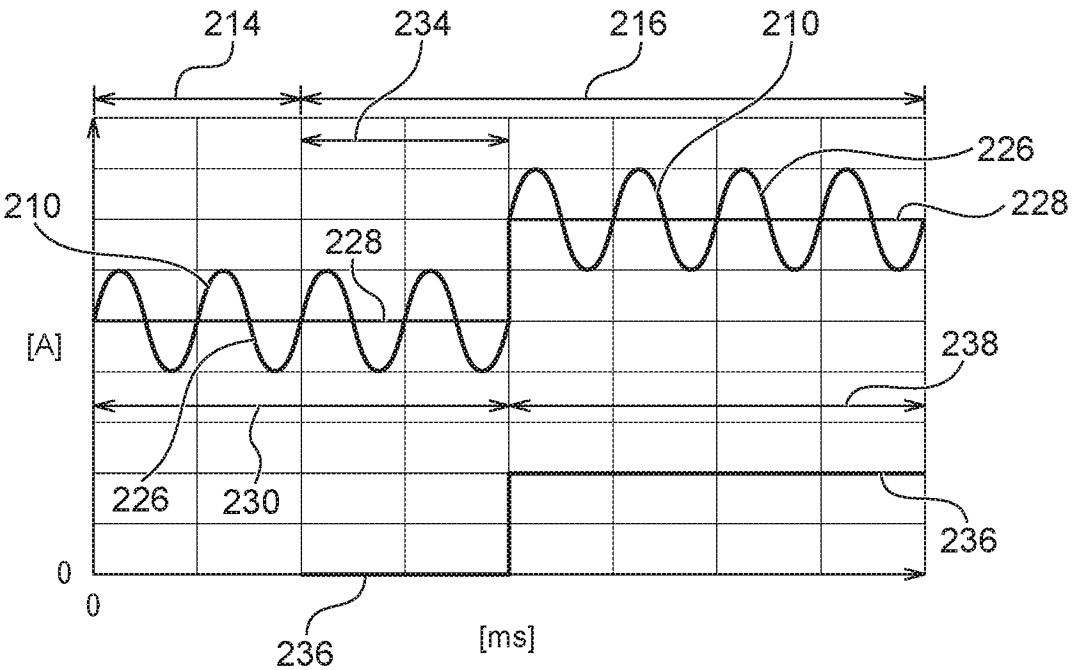
FIG. 18 is a view illustrating an embodiment for accumulating a current value that is obtained by subtracting a predetermined value from a current value that is detected for a prescribed interval.
Figure 19:
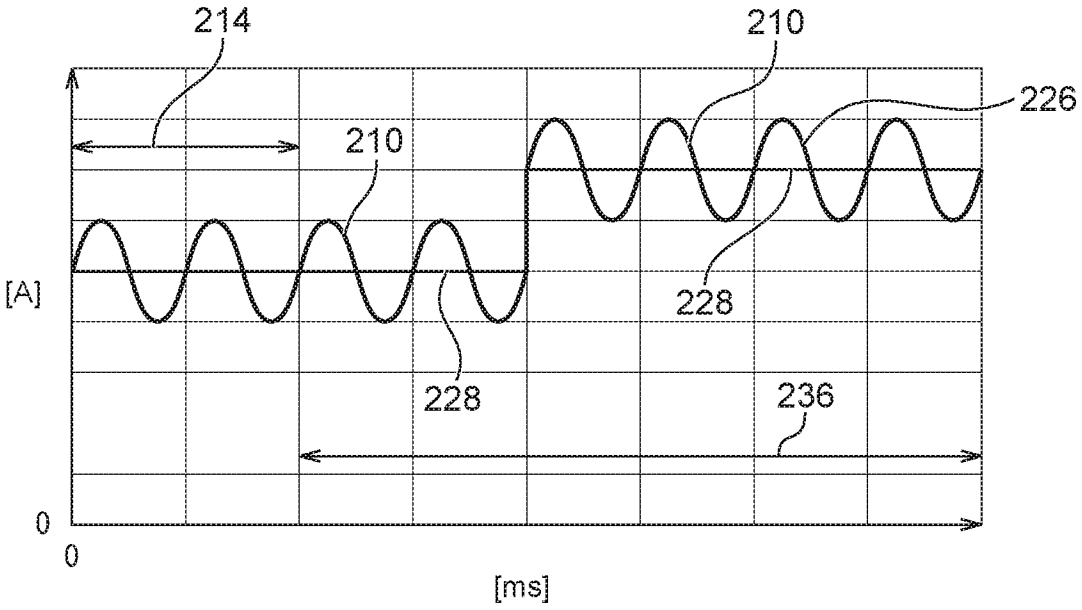
FIG. 19 is a view illustrating the embodiment for accumulating a current value that is obtained by subtracting a predetermined value from a current value that is detected for a prescribed interval.
Figure 20:
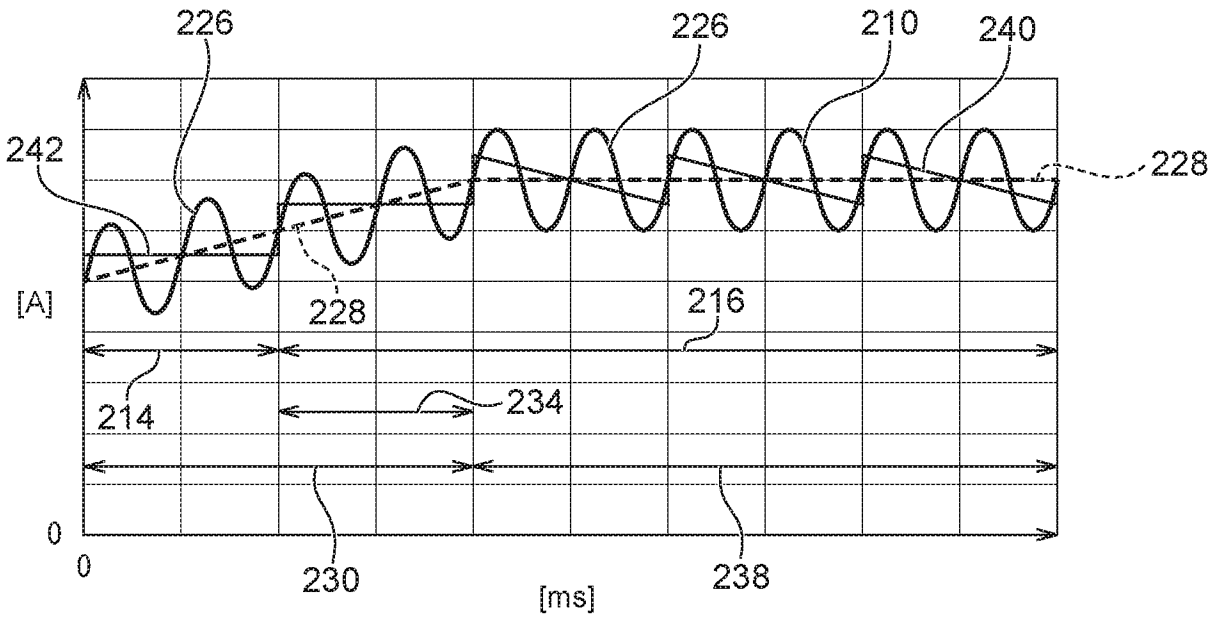
FIG. 20 is a view illustrating an embodiment for accumulating a current value that is obtained by subtracting a predetermined value from a current value that is detected for a prescribed interval.
Figure 21:
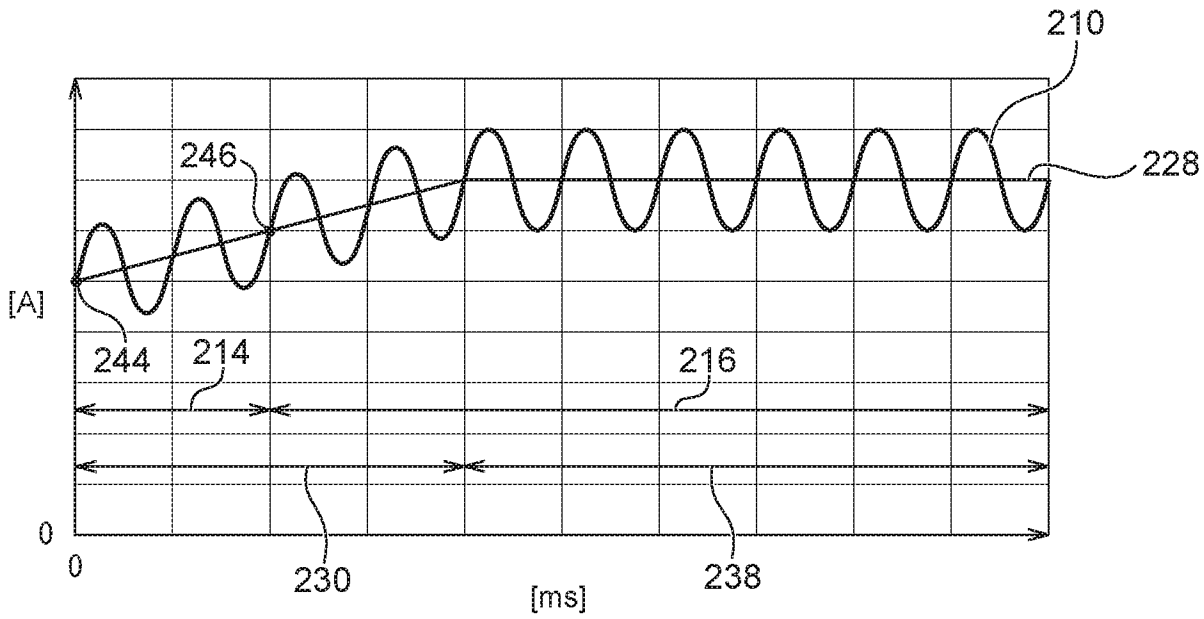
FIG. 21 is a view illustrating the embodiment for accumulating a current value that is obtained by subtracting a predetermined value from a current value that is detected for a prescribed interval.
Figure 22:
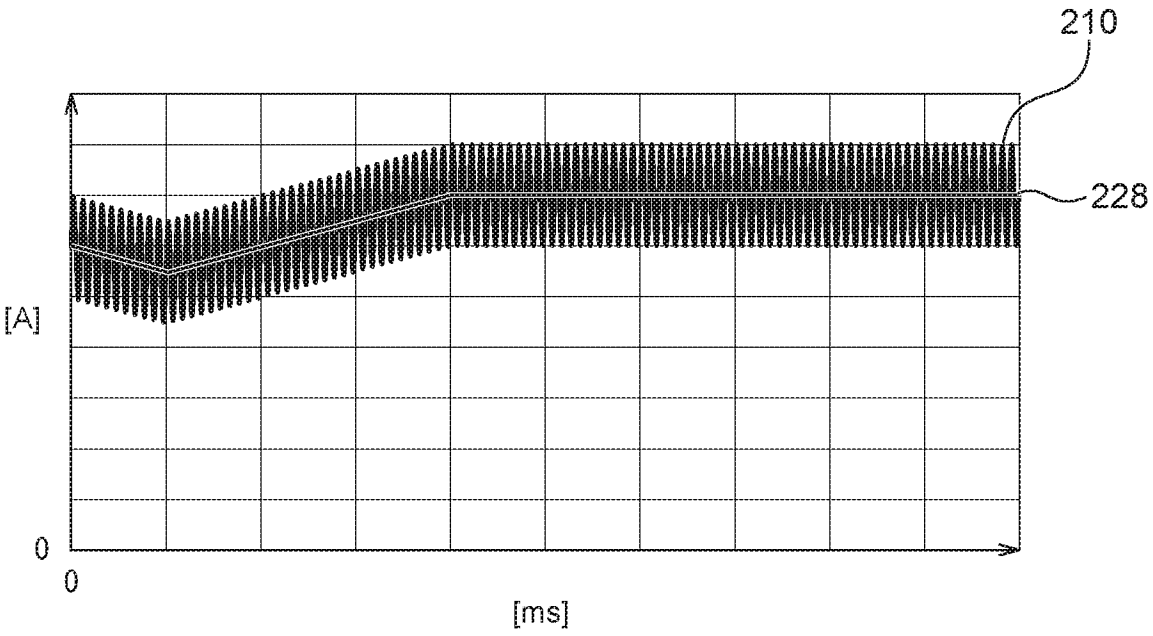
FIG. 22 is a view illustrating the embodiment for accumulating a current value that is obtained by subtracting a predetermined value from a current value that is detected for a prescribed interval.

Next, other embodiments of the accumulation portion 110 will be described with reference to FIGS. 18 to 22. In FIGS. 18 to 22, the horizontal axis represents time (milliseconds) and the vertical axis represents a current value (amperes). In these embodiments, the accumulation portion 110 accumulates a current value that is obtained by subtracting a predetermined value from a current value that is detected for a prescribed interval, and the difference portion 112 determines a difference between a current value detected in an interval that is different from the prescribed interval and the accumulated current value after subtraction. FIGS. 18 and 19 are views for describing an embodiment where the predetermined value is an average value of the current value detected for the prescribed interval. The embodiment in FIGS. 18 and 19 is an improvement of the embodiment in FIG. 15. An embodiment in FIGS. 20 to 22 is a further improvement of the embodiment in FIGS. 18 and 19. In FIGS. 18 to 22, a prescribed interval 214 corresponds to a time period in which the polishing table 12 rotates once. Note that, in the present invention, the prescribed interval 214 is not limited to the time period in which the polishing table 12 rotates once, and may be set in accordance with the period of the noise.

Motor current that is accumulated in the accumulation portion includes a first component 226, and a component that is different from the first component 226 and that changes slowly over time (a component which is assumed to be an amount representing a change in the film thickness, and which is referred to as a "second component 228" in the following). For example, the first component 226 includes above-described long-period noise with a period of 1 to 15 seconds, that is, 1 to 1/15 Hz when converted to frequency.

In FIG. 18, it is assumed that an interval 234 and an interval 238 are included in an interval 216 that is different from the prescribed interval 214. The size of the second component 228 and the way it changes are different between the prescribed interval 214 and the interval 238 that is different from the prescribed interval 214. However, the size of the second component 228 and the way it changes are the same for the prescribed interval 214 and for the interval 234 that is different from the prescribed interval 214.

The first component 226 is the same for the prescribed interval 214 and for the interval 216 that is different from the prescribed interval 214. The second component 228, which is the amount representing a change in the film thickness, is changed. Accordingly, only the second component 228 is desirably detected. The first component 226 is approximately the same for the prescribed interval 214 and for the interval 216 that is different from the prescribed interval 214. The second component 228 in the prescribed interval is subtracted from a table current 210 that is detected in the prescribed interval, and only the first component 226 is accumulated. The second component 228 in the interval 216 is obtained by subtracting a current value (first component) which has been subjected to subtraction and has been accumulated in the prescribed interval 214 from the table current 210 in the interval 216.

FIGS. 18 and 19 are views for describing data which the accumulation portion 110 accumulates, and the details of a processing result obtained by the difference portion 112. FIG. 18 illustrates a processing result of processing by the method illustrated in FIG. 15. FIG. 19 illustrates a processing result that is obtained by processing the same table current 210 as in FIG. 18 by the method of accumulating a current value that is obtained by subtracting a predetermined value from a current value that is detected for the prescribed interval.

FIG. 18 illustrates the table current 210 before difference processing, and an output signal 236 after the difference processing. The table current 210 is a sum of the first component 226, and the second component 228 that changes slowly over time. Note that, in FIGS. 18 to 22, the table current 210 is assumed to form two sinusoidal waves during the prescribed interval 214 in which the table 12 makes one rotation.

In FIGS. 18 and 19, the table current 210 includes the first component 226, which is a sine wave, and the second component 228, which is constant in a certain interval. The second component 228, which is the central value of the amplitude, is different between an interval 230 and the interval 238 following the interval 230. As illustrated in FIG.

18, according to the method illustrated in FIG. 15, the table current 210 in the prescribed interval 214 itself is the reference data.

A signal that is output after being subjected to the difference processing by the method illustrated in FIG. 15 takes a value that is obtained by subtracting the table current 210 in the prescribed interval 214 from the table current 210 in the interval 216. Accordingly, the second component 228 is the same for the prescribed interval 214 and for the interval 234 immediately after the prescribed interval 214, and both the first component 226, which is a sine wave, and the second component 228 are cancelled. As illustrated in FIG. 18, the value 236 after subtraction is zero in the interval 234. Accordingly, with the method illustrated in FIG. 15, in the case where the average value of the table current 210 is zero, the size of the film thickness itself can be detected.

As illustrated in FIG. 18, in the interval 238 following the interval 234, because the second component 228 is different, the second component 228, which is a sine wave, is cancelled, and the difference in the central value (second component 228) to the reference data is given as the output signal 236. Accordingly, with the method illustrated in FIG. 15, in the case where the average value is not zero, detection of only the amount representing the change in the film thickness is enabled. However, the size of the amplitude of the output signal 236 is very different from the table current 210. Accordingly, in the case where it is desired to find the size of the film thickness itself, there is room for improvement in the method illustrated in FIG. 15.

As a measure for improvement, that a first component 218, that is, a sine wave, is approximately the same for the prescribed interval 214 and for the interval 216 that is different from the prescribed interval 214 is used. Specifically, as illustrated in FIG. 19, the first component 226 is accumulated by subtracting the second component 228 from the current value (table current 210) that is detected in the prescribed interval 214. The second component 228 may be obtained by subtracting from the table current 210, in the interval 216 that is different from the prescribed interval 214, the current value (first component 226 that is the reference data) which is accumulated after subtraction of the second component 228.

In the prescribed interval 214, the second component 228 to be used for calculation of the first component 226 is calculated in the following manner. After polishing is started, when polishing stabilizes, the average value of the table current 210 is calculated for a time period in which the polishing table 12 rotates once. The reference data is created by subtracting the calculated average value from the table current 210 in the time period, following the time period in which the average value was calculated, in which the polishing table 12 rotates once (this time period is the prescribed interval 214). This is expressed by the equation below.

Reference data=table current 210−average value By taking into account the average value of the reference data illustrated in FIG. 15, only the sine wave is cancelled in the interval 216, and the absolute value of the table current 210 (second component 228) is output. Even if the absolute value is changed, if the first component 226 is the same sine wave component, the first component 226 is cancelled, and the absolute value of the table current 210 can be output. That is, the size of the film thickness itself may be found.

Next, another embodiment of the accumulation portion 110 will be described with reference to FIGS. 19 and 20. In the present embodiment, a current value (table current 210) that is detected for a prescribed interval is obtained by adding a first component that changes periodically, and a second component that changes linearly, and a predetermined value is the second component in the prescribed interval 214. FIGS. 20 and 21 are views for describing data which the accumulation portion 110 accumulates, and the details of a processing result obtained by the difference portion 112. FIG. 20 illustrates a processing result of processing by the method illustrated in FIG. 19. In FIG. 21, the same table current 210 as in FIG. 20 is processed, but a predetermined value is set taking into account that the second component 228 changes linearly. FIG. 21 illustrates a processing result of processing performed by a method of accumulating a current value that is obtained by subtracting the predetermined value from the table current 210 that is detected for the prescribed interval.

FIG. 20 illustrates the table current 210 before difference processing, and an output signal 240 after the difference processing. The output signal 240 is obtained by the calculation method in FIG. 19. The table current 210 is a sum of the first component 226, and the second component 228 that changes slowly over time.

In FIGS. 20 and 21, the table current 210 includes the first component 226, which is a sine wave, and the second component 228, which changes linearly in the interval 230. The second component 228, which is constant in the interval 238 following the interval 230, is included. As illustrated in FIG. 20, according to the method illustrated in FIG. 19, an average value 242 of the table current 210 in the prescribed interval 214 is the predetermined value. The reference data is created by subtracting the calculated average value 242 from the table current 210 in the prescribed interval 214.

The second component 228 may be accurately obtained by subtracting the reference data from the table current 210 in the interval 234. Because the gradient of the second component 228 is the same for the prescribed interval 214 and for the interval 234, the first component 226 may be correctly cancelled in the interval 234. However, the gradient of the second component 228 is different between the interval 238 and the prescribed interval 214, and although the sine wave, which is the first component 226, may be cancelled, the gradient in the prescribed interval 214 appears in the output signal 240. In the interval 238, the output signal 240 should be flat, but has a sawtooth waveform. This sawtooth wave becomes a cause for new noise, and accordingly, the method of creating the reference data has to be changed for the table current 210 as illustrated in FIG. 20.

A method of creating appropriate reference data is as follows. That the first component 218, that is, the sine wave, is approximately the same for the prescribed interval 214 and for the interval 216 that is different from the prescribed interval 214 is used. Specifically, accumulation is performed by subtracting the second component 228 with a gradient from the current value (table current 210) that is detected in the prescribed interval 214. In the interval 216 that is different from the prescribed interval 214, the correct second component 228 may be obtained by subtracting, from the table current 210, the current value (first component 226, which is the reference data) which is accumulated after subtraction of the second component 228.

In the prescribed interval 214, the second component 228 to be used for calculation of the first component 226 is, for example, calculated in the following manner. After polishing is started, the gradient of the table current 210 is calculated for two cycles of sine wave when polishing is stabilized. The reason why the number of cycles is two is because the length of the prescribed interval 214 corresponds to two cycles. The property that the difference between the second component 228 at a start point 244 of the two cycles and the second component 228 at an endpoint 246 is equal to the difference between the table current 210 at the start point 244 and the table current 210 at the endpoint 246 as illustrated in FIG. 21 is used.

Note that the property that the difference in the second component 228 is equal to the difference in the table current 210 is true for combinations other than the start point 244 and the endpoint 246 of the two cycles. This property may be established between measurement points that are separate from each other by a length of integral multiple of one cycle. By how many times of one cycle the measurement points should be separate from each other so as to make the difference in the table current 210 equal depends on the polishing target, the polishing conditions, the elapsed time from the start of polishing, and the like.

In the present embodiment, the difference in the second component 228 may be obtained by determining the difference in the table current 210 between measurement points that are separate from each other by the length of the prescribed interval 214 at the time of stabilization of polishing after polishing was started. When the difference in the second component 228 between the measurement points that are separate from each other by the length of the prescribed interval 214 is obtained, the gradient of the second component 228 can be found, and the second component 228 can be expressed by a linear function of time. Two cycles following the period in which the gradient was determined is made the prescribed interval 214. When using the linear function, the second component 228 may be accurately subtracted from the table current 210 in the prescribed interval 214. The reference data is created in this manner. By using the reference data on the interval 216, the second component 228 may be accurately calculated in the interval 216.

FIG. 21 is the result of correcting the reference data illustrated in FIG. 20. By taking into account the gradient of the reference data illustrated in FIG. 20, only the sine wave is cancelled, and the central value (second component 228) of the table current 210 is output. Even in a case where the second component 228 is changed linearly, if the first component 226 is the same sine wave component, the first component 226 is cancelled, and the absolute value of the table current 210 can be output. That is, the size of the film thickness itself can be found.

A method similar to that illustrated in FIG. 21 can be adopted in a case where the second component 228 of a specific cycle different from the cycle of the first component 226 is included during the length of the prescribed interval 214, or where the second component 228 is bent in a zigzag manner during the length of the prescribed interval 214. An example is illustrated in FIG. 22. In FIG. 22, the second component 228 is zigzagged. Because a zigzag line can be assumed to be a combination of straight lines, the second component 228 can be expressed by a linear function of time by applying the method illustrated in FIG. 21 to each straight line. The second component 228 is subtracted from the table current 210 in the prescribed interval 214 by using the obtained linear function. The reference data is created in this manner.

In a case where the second component 228 of a specific cycle different from the cycle of the first component 226 is included during the length of the prescribed interval 214, the specific cycle may be longer than the cycle of the first component 226 and may be approximated by a straight line. In such a case, the second component 228 can be expressed by a linear function of time by applying the method illustrated in FIG. 21. Then, the second component 228 is subtracted from the table current 210 in the prescribed interval 214. The reference data is created in this manner.

Figure 23:
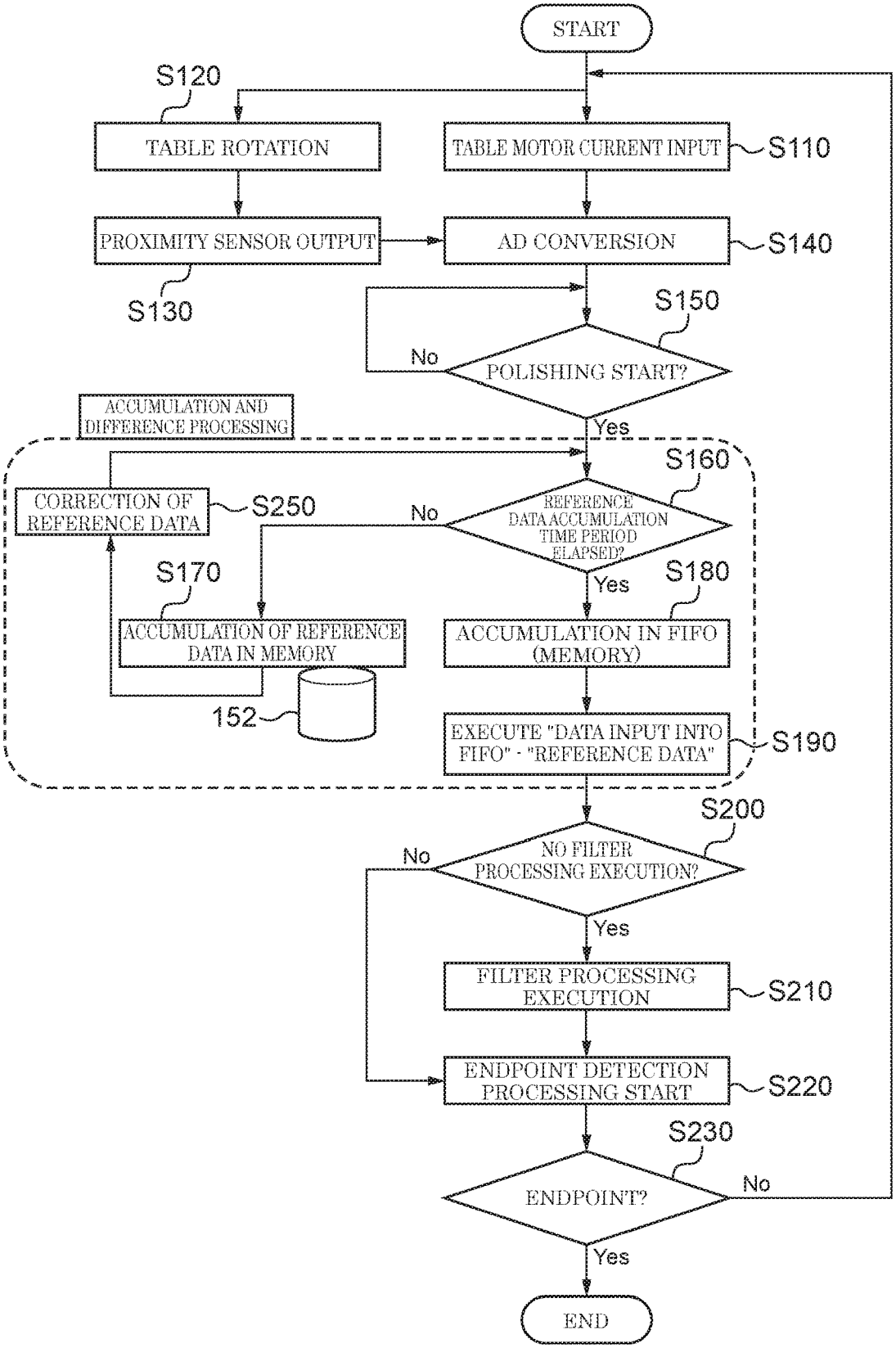
FIG. 23 is a flowchart illustrating an embodiment for accumulating a current value that is obtained by subtracting a predetermined value from a current value that is detected for a prescribed interval.

Next, one example of control according to the embodiment illustrated in FIGS. 18 and 19 by the control portion 50 will be further described by means of FIG. 23. FIG. 23 is a flowchart illustrating one example of control of the respective portions by the control portion 50. In the present flow, the accumulation portion 110 collects reference data during polishing, that is, acquires reference data immediately after polishing is started. The present flow is the flow illustrated in FIG. 16 with a partial change. Step S250 is added.

In step S250, the following process is performed. After polishing is started, the average value of the table current 210 is calculated for two cycles when polishing is stabilized, immediately after two cycles of the table current 210 is accumulated in the memory 152. The reference data is created by subtracting the calculated average value from the table current 210 in the following two cycles (prescribed interval 214), and is accumulated in the memory 152.

As described above, the present invention has the following forms.

According to a first form of the polishing apparatus of the invention of the present application, a polishing apparatus is provided that has a first electric motor that rotationally drives a polishing table for performing polishing between a polishing pad and a polishing object that is disposed facing the polishing pad, and a second electric motor that rotationally drives a holding portion for holding the polishing object and pressing the polishing object against the polishing pad; the polishing apparatus further including: a current detection portion that detects a current value of at least one of the first and second electric motors; an accumulation portion that accumulates the detected current value for a prescribed interval; a difference portion that determines a difference between the detected current value in an interval that is different to the prescribed interval and the accumulated current value; and an endpoint detection portion that detects a polishing endpoint that indicates an end of the polishing, based on a change in the difference that the difference portion outputs.

With regard to a case where noise produced by hardware (a motor) cannot be removed even if a noise filter is used, results of studies regarding the cause of the noise generation in such a case showed that the following factor causes such noise. The number of rotations of the table is, for example, around 60 RPM, and when converted to frequency this is equivalent to approximately 1 Hz. Further, noise is present that has a frequency that is lower than that of the number of rotations of the table, that is, noise with a frequency lower than 1 Hz, that is noise which is repeated approximately regularly. For example, long-period noise with a period of 1 to 15 seconds, that is, 1 to 1/15 Hz when converted to frequency, is present. In the case of removing such noise using a low-pass filter, it is necessary for the cut-off frequency of the low-pass filter to be 1 to 1/15 Hz or less. However, when such a low-pass filter is used, the usage thereof influences changes in the frictional force that is the detection object. This is because changes in the frictional force have a low frequency of an equivalent level.

Therefore, to remove such noise, a configuration is adopted in which a low-pass filter is not used and which is provided with an accumulation portion that accumulates detected current values for a prescribed interval, a difference portion that determines a difference between a current value detected in an interval that is different from the prescribed interval and an accumulated current value, and an endpoint detection portion that detects a polishing endpoint that indicates an end of polishing based on a change in the difference that the difference portion outputs. In this case, the prescribed interval is determined according to the period of the noise that it is desired to remove. For example, the prescribed interval is caused to match the period of the noise that it is desired to remove. By this means, long-period noise that is repeated approximately regularly can be removed.

As a method for determining the difference, for example, a method is available that subtracts data of the same phase as the noise to eliminate unevenness in the data due to the noise, that is, subtracts an accumulated current value from a current value detected in an interval that is different from the prescribed interval to thereby remove the noise. Further, a method is also available that adds data of the opposite phase to the noise to thereby eliminate unevenness in the data due to the noise, that is, adds a value obtained by reversing the sign of the accumulated current value to a current value detected in an interval that is different to the prescribed interval to thereby remove the noise. These are methods that perform substantially equivalent processing.

According to a second form of the polishing apparatus of the invention of the present application, the polishing apparatus has a position detection portion that detects a rotational position of at least one of the polishing table and the holding portion, wherein the prescribed interval is set based on the detected position.

In this case the following problem can be solved. Because a frictional force is always acting between the polishing table and the holding portion, it is sometimes difficult to accurately maintain the number of rotations of the polishing table and the holding portion at a constant value. In this case, the problem arises that it is difficult to align a phase of a current value accumulated for a prescribed interval and a current value detected in an interval that is different to the prescribed interval. That is, it is difficult to find phase synchronization between a current value in the prescribed interval and a current value in an interval that is different to the prescribed interval (this is caused by a lag with respect to synchronization of rotations of the table and the like). Therefore, by providing a position detection portion that detects a rotational position, and setting the prescribed interval based on the detected position, it is possible to synchronize rotation in the prescribed interval with rotation in an interval that is different to the prescribed interval. Specifically, a method can be adopted that uses trigger signal generation means for recognizing a table rotational position or that monitors a notch provided at a predetermined position on the table.

According to a third form of the polishing apparatus of the invention of the present application, the accumulation portion accumulates the current value that is detected in a period in which at least one of the polishing table and the holding portion makes one rotation.

According to a fourth form of the polishing apparatus of the invention of the present application, the prescribed interval is an interval that is required for at least one of the polishing table and the holding portion to make one rotation or more.

According to a fifth form of the polishing apparatus of the invention of the present application, in a case where a rotational speed of the polishing table and a rotational speed of the holding portion are different, when a faster rotational speed is taken as "a" and a slower rotational speed is taken as "b", the prescribed interval is an interval that is necessary for a member having a slower rotational speed among the polishing table and the holding portion to make (b/(a−b)) rotations.

In the third to fifth forms, current values corresponding to at least one rotation are accumulated. This is because there are many cases in which the noise that is taken as an object of the present invention has a long period that extends for an interval of one rotation or more of the polishing table or the holding portion. The optimal number of rotations for which data is to be used depends on the polishing conditions (state of a film on the wafer, the material, the rotational frequency of the motor and the like).

As one example, in some cases, after the polishing table and the holding portion have rotated a number of times, a period that it takes for the polishing table and the holding portion to return relatively to the original positional relationship therebetween is preferable as the prescribed interval. A period that it takes for the polishing table and the holding portion to return relatively to the original positional relationship therebetween is an interval that is required in order for the member having the slower rotational speed among the polishing table and the holding portion to make (b/(a−b)) rotations in the fifth form.

According to a sixth form of the polishing apparatus of the invention of the present application: at least one electric motor among the first and second electric motors includes windings of a plurality of phases, the current detection portion detects currents of at least two phases among phases of the first and second electric motors, the accumulation portion accumulates current values of the detected at least two phases for a prescribed interval, and the difference portion determines the difference with respect to each current of the at least two phases; the polishing apparatus further including a rectification operation portion that rectifies current detection values of at least two phases that are differences that the difference portion outputs, and with respect to signals of at least two phases that are rectified, performs addition for adding together the signals of at least two phases and/or multiplication for multiplying the signals of at least two phases by a predetermined multiplier and outputs a resultant value; wherein the endpoint detection portion detects a polishing endpoint indicating an end of the polishing based on a change in an output of the rectification operation portion.

According to a seventh form of the polishing apparatus of the invention of the present application: at least one electric motor among the first and second electric motors includes windings of a plurality of phases, and the current detection portion detects currents of at least two phases among phases of the first and second electric motors; the polishing apparatus further including a rectification operation portion that rectifies current detection values of at least two phases that are detected by the current detection portion, and with respect to signals of at least two phases that are rectified, performs addition for adding together the signals of at least two phases and/or multiplication for multiplying the signals of at least two phases by a predetermined multiplier and outputs a resultant value; wherein: the accumulation portion accumulates, for a prescribed interval, current values of at least two phases that the rectification operation portion outputs; the difference portion determines the difference based on each current of the at least two phases; and the endpoint detection portion detects a polishing endpoint indicating an end of the polishing based on a change in the difference that the difference portion outputs.

According to the above described form, the following advantageous effects are obtained in the case of rectifying and adding driving currents of a plurality of phases. That is, in a case of detecting only a driving current of a single phase, the current value that is detected is small in comparison to the present form. According to the present form, the current value increases as the result of rectification and addition, and hence the detection accuracy improves.

Further, in the case of a motor, such as an AC servo motor, that has a plurality of phases within a single motor, since the rotational speed of the motor is managed without individually managing currents of the respective phases, in some cases the current values vary between the phases. Therefore, conventionally, there has been the possibility of detecting a current value of a phase whose current value is small in comparison to other phases, and there has thus been the possibility that a phase that has a large current value cannot be utilized. According to the present form, because driving currents of a plurality of phases are added, a phase that has a large current value can be utilized and hence the detection accuracy improves.

In addition, since driving currents of a plurality of phases are rectified and added, ripples decrease in comparison to a case which uses only the driving current of a single phase. Consequently, since a detected alternating current is used for determining an endpoint, ripples of a direct current obtained by effective value conversion that converts to a direct current also decrease, and endpoint detection accuracy improves.

The currents to be added may be currents of at least one phase of the first electric motor and of at least one phase of the second electric motor. By this means, the signal value can be increased in comparison to a case of utilizing only a current value of one of the motors.

In a case of rectifying driving currents of a plurality of phases and performing multiplication with respect to signals that are obtained, there is the advantageous effect that the range of values obtained by multiplication can be adapted to an input range of a processing circuit of a subsequent stage. Further, there is also the advantageous effect that a signal of only a specific phase can be increased (for example, a phase in which noise is less in comparison to other phases) or decreased (for example, in a case where noise is large in comparison to other phases).

Both addition and multiplication can also be performed. In this case, the above described effect of addition and effect of multiplication can both be obtained. A numerical value (multiplier) by which to multiply may also be changed for each phase. In a case where a result obtained by adding exceeds the input range of a processing circuit at a subsequent stage or the like, the multiplier is made less than 1.

Note that, although the rectification may be either of half-wave rectification and full-wave rectification, full-wave rectification is more preferable than half-wave rectification because the amplitude increases and ripples decrease.

Further, according to the above described form, noise can be removed by subtracting a reference waveform (current value accumulated for a prescribed interval) including noise caused by hardware from an analog waveform prior to undergoing effective value conversion (DC conversion). After undergoing the DC conversion, subtraction is difficult because extraction and subtraction of only a noise component cannot be performed when friction is changing, because of the DC conversion. That is, this is because subtraction that is in accordance with the amplitude of the noise is difficult.

According to an eighth form of the polishing apparatus of the invention of the present application, the polishing apparatus has at least one of the amplification portion, the subtraction portion and a noise removal portion, wherein a signal that is amplified at the amplification portion is subjected to subtraction at the subtraction portion and, at the noise removal portion, noise is removed from a signal obtained after undergoing the subtraction.

A change in a torque current can be increased by amplification. By removing noise, a change in a current that is buried in noise can be made apparent.

The subtraction portion has the following advantageous effects. A current that is detected usually includes a current part that changes accompanying a change in a frictional force, and a current part (bias) of a fixed amount that does not change even if the frictional force changes. By removing this bias, it is possible to extract only the current part that depends on a change in the frictional force and to amplify the current part up to a maximum amplitude within a range in which signal processing is possible, and thus improve the accuracy of an endpoint detection method that detects an endpoint based on a change in the frictional force.

Note that, in a case where the polishing apparatus has a plurality of portions among the amplification portion, subtraction portion and the noise removal portion, these are connected in cascade. For example, in a case where the polishing apparatus has the amplification portion and the noise removal portion, after processing is first performed at the amplification portion, the processing result is sent to the noise removal portion and processed at the noise removal portion, or processing is first performed at the noise removal portion and the processing result thereof is sent to the amplification portion to perform processing.

According to a ninth form of the polishing apparatus of the invention of the present application, the polishing apparatus has the amplification portion, the subtraction portion and a noise removal portion, and a signal that is amplified at the amplification portion is subjected to subtraction at the subtraction portion and, at the noise removal portion, noise is removed from a signal obtained after undergoing the subtraction. According to the above described form, because subtraction and noise removal are performed with respect to a signal having a large amplitude after amplification, the subtraction and noise removal can be performed accurately. As a result, the endpoint detection accuracy improves.

Note that, although amplification, subtraction and noise removal are preferably performed in this order, these processes need not necessarily be performed in this order. For example, it is also possible to perform these processes in the order of noise removal, subtraction and amplification.

According to a tenth form of the polishing apparatus of the invention of the present application, the polishing apparatus has a second amplification portion that further amplifies a signal obtained after the noise removal. According to this form, the size of a current that was reduced by noise removal can be restored, and the accuracy of the endpoint detection method improves.

According to an eleventh form of the polishing apparatus of the invention of the present application, the polishing apparatus has the amplification portion and a control portion that controls amplification characteristics of the amplification portion. According to this form, optimal amplification characteristics (amplification factor and frequency characteristic or the like) can be selected in accordance with the material and structure and the like of the polishing target.

According to a twelfth form of the polishing apparatus of the invention of the present application, the polishing apparatus has the noise removal portion and a control portion that controls noise removal characteristics of the noise removal portion. According to this form, optimal noise removal characteristics (pass band or attenuation amount of a signal or the like) can be selected in accordance with the material and structure and the like of the polishing object.

According to a thirteenth form of the polishing apparatus of the invention of the present application, the polishing apparatus has the subtraction portion and a control portion that controls subtraction characteristics of the subtraction portion. According to this form, optimal subtraction characteristics (subtraction amount and frequency characteristic or the like) can be selected in accordance with the material and structure and the like of the polishing object.

According to a fourteenth form of the polishing apparatus of the invention of the present application, the polishing apparatus has a control portion that controls amplification characteristics of the second amplification portion. According to this form, optimal second amplification characteristics (amplification factor and frequency characteristic or the like) can be selected in accordance with the material and structure and the like of the polishing object.

According to a fifteenth form of the polishing apparatus of the invention of the present application, a polishing method is provided. The polishing method is a method for performing polishing between a polishing pad and a polishing object that is disposed facing the polishing pad and which uses a polishing apparatus having a first electric motor that rotationally drives a polishing table for holding the polishing pad, a second electric motor that rotationally drives a holding portion for holding the polishing object that is disposed facing the polishing pad and pressing the polishing object against the polishing pad, and a current detection portion that detects a current value of at least one of the first and second electric motors, the method including: an accumulation step of accumulating the detected current value for a prescribed interval; a difference step of determining a difference between the detected current value in an interval that is different to the prescribed interval and the accumulated current value; and an endpoint detection step of detecting a polishing endpoint that indicates an end of the polishing, based on a change in the difference that the difference step outputs. According to this form, the same advantageous effects as those of the first form can be achieved.

According to a sixteenth form of the polishing apparatus of the invention of the present application, the accumulation portion accumulates a current value that is obtained by subtracting a predetermined value from the current value that is detected for the prescribed interval, and the difference portion determines a difference between the detected current value in the interval that is different from the prescribed interval and the accumulated current value after subtraction. According to this form, the following advantageous effects are obtained. Motor current that is accumulated in the accumulation portion includes a first component, and a component that is different from the first component and that changes slowly over time (a component which is assumed to be an amount representing a change in the film thickness, and which is referred to as a "second component" in the following). For example, the first component includes above-described long-period noise with a period of 1 to 15 seconds, that is, 1 to 1/15 Hz when converted to frequency.

The size of the second component and the way it changes are different between the prescribed interval and the interval that is different from the prescribed interval. The first component is the same for the prescribed interval and the interval that is different from the prescribed interval. The second component which is the amount representing a change in the film thickness is changed. Accordingly, it is desirable that only the second component can be detected.

Accordingly, by using that the first component is approximately the same for the prescribed interval and an interval that is different from the prescribed interval, the second component ("predetermined value" in the present embodiment) in the prescribed interval is subtracted from the current value that is detected in the prescribed interval, and only the first component is accumulated. The second component in the interval that is different from the prescribed interval may be obtained by determining the difference to the accumulated current value (first component) after subtraction in the interval that is different from the prescribed interval. Additionally, the rate of change of the second component, which is the amount representing a change in the film thickness, varies depending on the polishing target or the polishing conditions. For example, the second component may be assumed to be constant (corresponding to a seventeenth form), straight (corresponding to a nineteenth form below), zigzagged (corresponding to a twentieth form below), or a sine wave (corresponding to an eighteenth form below) in the prescribed interval. If the second component is constant for the prescribed interval (corresponding to the seventeenth form below), the second component may be assumed to be the average value of the current value that is detected for the prescribed interval.

According to the seventeenth form of the polishing apparatus of the invention of the present application, the predetermined value is an average value of the current value that is detected for the prescribed interval.

According to the eighteenth form of the polishing apparatus of the invention of the present application, the current value that is detected for the prescribed interval is obtained by adding a first component of a first cycle and a second component of a second cycle that is longer than the first cycle, and the predetermined value is the second component.

According to the nineteenth form of the polishing apparatus of the invention of the present application, the current value that is detected for the prescribed interval is obtained by adding a first component that changes periodically and a second component that changes linearly, and the predetermined value is the second component.

According to the twentieth form of the polishing apparatus of the invention of the present application, the current value that is detected for the prescribed interval is obtained by adding a first component that changes periodically and a second component that changes in a zigzag manner, and the predetermined value is the second component.

Although the embodiments of the present invention have been described above based on some examples, the described embodiments are for the purpose of facilitating the understanding of the present invention and are not intended to limit the present invention. The present invention may be modified and improved without departing from the spirit thereof, and the invention includes equivalents thereof. In addition, the elements described in the claims and the specification can be arbitrarily combined or omitted within a range in which the above-mentioned problems are at least partially solved, or within a range in which at least a part of the advantages is achieved.

This application claims priority under the Paris Convention to Japanese Patent Application No. 2015-204767 filed on Oct. 16, 2015 and Japanese Patent Application No. 2016-164343 filed on Aug. 25, 2016. The entire disclosure of Japanese Patent Application No. 2015-204767 filed on Oct. 16, 2015 and Japanese Patent Application No. 2016-164343 filed on Aug. 25, 2016 including specification, claims, drawings and summary is incorporated herein by reference in its entirety. The entire disclosure of Japanese Patent Laid-Open No. 2001-198813 including specification, claims, drawings and summary is incorporated herein by reference in its entirety.

REFERENCE SIGNS LIST

12 Polishing table
14 First electric motor
18 Semiconductor wafer
20 Top ring
22 Second electric motor
24 Current detection portion
29 Endpoint detection portion
100 Polishing apparatus
110 Accumulation portion
112 Difference portion

What is claimed is:

1. A polishing apparatus for performing polishing between a polishing pad and a polishing object that is disposed facing the polishing pad, comprising:

a first electric motor that rotationally drives a polishing table for holding a polishing pad, and a second electric motor that rotationally drives a top ring for holding the polishing object and pressing the polishing object against the polishing pad, the polishing apparatus further comprising:

a current detection portion comprising a sensor that detects a current value of at least one of the first and second electric motors;

an accumulation portion comprising a memory and/or a non-transitory storage medium that accumulates the detected current value for a prescribed interval;

difference circuitry that determines a difference between the detected current value in an interval that is different to the prescribed interval and the accumulated current value; and endpoint detection circuitry that detects a polishing endpoint that indicates an end of the polishing based on a change in the difference that the difference circuitry outputs.

2. The polishing apparatus according to claim 1, further comprising a position detection portion comprising a sensor that detects a rotational position of at least one of the polishing table and the top ring, wherein the prescribed interval is set based on the detected position.

3. The polishing apparatus according to claim 1, wherein:

the accumulation portion is configured to accumulate the current value that is detected in a period in which at least one of the polishing table and the top ring makes at least one rotation.

4. The polishing apparatus according to claim 1, wherein:

the prescribed interval is an interval that is required for one of the polishing table and the top ring to make one rotation or more.

5. The polishing apparatus according to claim 1, wherein:

in a case where a rotational speed of the polishing table and a rotational speed of the top ring are different, when a faster rotational speed is taken as "a" and a slower rotational speed is taken as "b", the prescribed interval is an interval that is necessary for one of the polishing table and the top ring having a slower rotational speed to make (b/(a−b)) rotations.

6. The polishing apparatus according to claim 1, wherein:

at least one electric motor among the first and second electric motors includes windings of a plurality of phases, the current detection portion is configured to detect currents of at least two phases among phases of the first and second electric motors, the accumulation portion is configured to accumulate current values of the detected at least two phases for the prescribed interval, and the difference circuitry is configured to determine the difference with respect to each current of the at least two phases;

the polishing apparatus further comprising rectification operation circuitry that rectifies current detection values of at least two phases that are differences that the difference circuitry outputs, and with respect to signals of at least two phases that are rectified, performs addition for adding together the signals of at least two phases and/or multiplication for multiplying the signals of at least two phases by a predetermined multiplier and outputs a resultant value, wherein the endpoint detection circuitry is configured to detect a polishing endpoint indicating an end of the polishing, based on a change in the output of the rectification operation circuitry.

7. The polishing apparatus according to claim 1, wherein:

at least one electric motor among the first and second electric motors includes windings of a plurality of phases, and the current detection portion is configured to detect currents of at least two phases among phases of the first and second electric motors;

the polishing apparatus further comprising a rectification operation circuitry that rectifies current detection values of at least two phases that are detected by the current detection portion, and with respect to signals of at least two phases that are rectified, performs addition for adding together the signals of at least two phases and/or multiplication for multiplying the signals of at least two phases by a predetermined multiplier and outputs a resultant value, wherein the accumulation portion is configured to accumulate, for the prescribed interval, current values of at least two phases that the rectification operation circuitry outputs;

the difference circuitry is configured to determine the difference based on the current value of the at least two phases; and the endpoint detection circuitry is configured to detect a polishing endpoint indicating an end of the polishing based on a change in the difference that the difference circuitry outputs.

8. The polishing apparatus according to claim 6, comprising at least one of:

an amplifier that amplifies an output of the rectification operation circuitry, a noise removal circuitry that removes noise included in an output of the rectification operation circuitry, and a subtraction circuitry that subtracts a predetermined amount from an output of the rectification operation circuitry.

9. The polishing apparatus according to claim 8, comprising the amplifier, the subtraction circuitry and the noise removal circuitry, wherein:

a signal amplified at the amplifier is subjected to subtraction at the subtraction circuitry, and, at the noise removal circuitry, noise is removed from a signal obtained after the subtraction.

10. The polishing apparatus according to claim 9, comprising a second amplifier that further amplifies a signal obtained after the noise removal.

11. The polishing apparatus according to claim 8, comprising:

the amplifier, and a controller that controls amplification characteristics of the amplifier.

12. The polishing apparatus according to claim 8, comprising:

the noise removal circuitry, and a controller that controls noise removal characteristics of the noise removal circuitry.

13. The polishing apparatus according to claim 8, comprising:

the subtraction circuitry, and a controller that controls subtraction characteristics of the subtraction circuitry.

14. The polishing apparatus according to claim 10, comprising a controller that controls amplification characteristics of the second amplifier.

15. The polishing apparatus according to claim 1, wherein:

the accumulation portion accumulates a current value that is obtained by subtracting a predetermined value from the current value that is detected for the prescribed interval, and the difference circuitry determines a difference between the detected current value in the interval that is different from the prescribed interval and the accumulated current value after subtraction.

16. The polishing apparatus according to claim 15, wherein:

the predetermined value is an average value of the current value that is detected for the prescribed interval.

17. The polishing apparatus according to claim 15, wherein:

the current value that is detected for the prescribed interval is obtained by adding a first component of a first cycle and a second component of a second cycle that is longer than the first cycle, and the predetermined value is the second component.

18. The polishing apparatus according to claim 15, wherein:

the current value that is detected for the prescribed interval is obtained by adding a first component that changes periodically and a second component that changes linearly, and the predetermined value is the second component.

19. The polishing apparatus according to claim 15, wherein:

the current value that is detected for the prescribed interval is obtained by adding a first component that changes periodically and a second component that changes in a zigzag manner, and the predetermined value is the second component.

* * * * *